US005353085A

United States Patent [19]

Kurematsu et al.

[11] Patent Number: 5,353,085

[45] Date of Patent: Oct. 4, 1994

[54] AUTOMATIC PROCESSOR FOR PROCESSING SILVER HALIDE PHOTOGRAPHIC LIGHT-SENSITIVE MATERIAL

[75] Inventors: Masayuki Kurematsu; Hideo Tanaka, both of Hachioji, Japan

[73] Assignee: Konica Corporation, Tokyo, Japan

[21] Appl. No.: 995,584

[22] Filed: Dec. 22, 1992

[30] Foreign Application Priority Data

Dec. 28, 1991 [JP] Japan ..... 3-358469
Apr. 20, 1992 [JP] Japan ..... 4-099463

[51] Int. Cl.[5] ..... G03D 3/02
[52] U.S. Cl. ..... 354/324; 204/182.4
[58] Field of Search ..... 354/324, 319-323; 134/64 P, 64 R, 122 P, 122 R; 204/182.3, 182.4

[56] References Cited

U.S. PATENT DOCUMENTS 4,939,073 7/1990 Koboshi et al. ..... 430/372
4,984,004 1/1991 Yoda et al. ..... 354/324 X
5,040,013 8/1991 Kurokawa et al. ..... 354/324 X
5,145,569 9/1992 Schneider et al. ..... 204/182.4
5,237,360 8/1993 Patton ..... 354/324

FOREIGN PATENT DOCUMENTS 57-132146 8/1982 Japan .
58-18631 2/1983 Japan .
58-34448 2/1983 Japan .
60-70841 5/1985 Japan .
60-263941 12/1985 Japan .
61-2153 1/1986 Japan .
62-201442 9/1987 Japan .

*Primary Examiner*—D. Rutledge
*Attorney, Agent, or Firm*—Finnegan, Henderson, Farabow, Garrett & Dunner

[57] ABSTRACT

An automatic processing system for photographic light-sensitive material, which includes an automatic processor having a processing tank containing a processing solution with which the material is processed, a replenisher of a concentrated processing replenisher chemical solution to the processing tank, an evaporator/distillator processor by which a waste liquid in photographic processing discharged from the automatic processor is evaporated and concentrated by heating, and vapor generated through the heating process is condensed by cooling process so that a condensate is produced. An electric dialysis device separates the condensate into an electric dialysis concentrated liquid and a desalted liquid. Cation exchange membranes and anion exchange membranes are arranged alternately in chambers to form concentrating chambers and desalting chambers alternately by both the ion membranes and chamber frames. The desalted liquid storage tank is provided for storing the desalted liquid which is supplied to the processing tank.

17 Claims, 17 Drawing Sheets

AUTOMATIC PROCESSOR FOR PROCESSING SILVER HALIDE PHOTOGRAPHIC LIGHT-SENSITIVE MATERIAL

BACKGROUND OF THE INVENTION

The present invention relates to an automatic processing system for photographic use wherein a silver halide photographic light-sensitive material is processed.

In photographic processing of a silver halide photographic light-sensitive material, a combination of steps of employing processing solutions having one or not less than two of functions of developing, fixing and washing for black and white light-sensitive materials, or of functions of color developing, bleach-fixing (or bleaching, fixing), washing and stabilizing for color light-sensitive materials is used. In the photographic processing wherein a large volume of light-sensitive materials are processed, there is provided a means for keeping the capability of processing solutions constant by maintaining components of processing solutions constant in the method to replenish components consumed during processing and to remove components which disolve out to processing solutions or condensed through evaporation during processing (for example, bromide ion in developer, silver complex salt in fixing solution). For the above-mentioned replenishment, replenisher is replenished in a processing solution and a part of processing solutions is wasted for removing condensed components in photographic processing.

In an automatic processor, photographic light-sensitive materials are processed by processing solutions in processing tanks, and processing solutions exhausted during processing are restored by processing agents for replenishment added thereto for continuous photographic processing. In this case, a capacity of a replenisher tank affects the capability of the automatic processor, and for improving processing capability, a capacity of the replenisher tank needs to be increased and replenisher tanks need to be replaced frequently, which is one of the causes for impairing easy maintenance.

Waste liquids of photographic processing solutions have been guided from processing tanks through waste liquid pipes, and have been dumped into sewerages or the like after being diluted by waste liquid of washing water and by cooling water for the automatic processor. Due to recent strict regulations for environmental pollution, however, dumping of waste liquids of photographic processing solutions other than those mentioned above, such as those of, for example, developer, fixer, color developer, bleach and fix (or bleaching solution, fixer) and stabilizer is substantially prohibited. Further, the invention relates to an evaporation and concentration processor for water solution such as, for example, waste liquid in photographic processing for silver halide photographic light-sensitive materials and a treating method for treating waste liquid in photographic processing wherein the evaporator/distillator processor is used.

With regard to an amount of a replenisher including washing water that is a replenisher for water washing, a system wherein an amount of a replenisher has been reduced remarkably for the reasons of environmental pollution and economy is becoming popular recently. Photo-finishing laboratories are now having their waste liquids collected by a special waste liquid disposal company, paying it a collection fee, or are installing waste-treatment facilities. In order to entrust such special waste liquid disposal company, waste liquids must be stored in a considerable broad space of a truster and it is extremely expensive in an aspect of cost.

Recently, photographic processing employing an automatic processor (so-called washless automatic processor) wherein stabilizing processing substituting for water washing is employed and no piping for supplying and draining washing water is needed around the automatic processor is becoming popular. For this processing, a processor wherein cooling water for controlling the temperature of processing solutions is eliminated is desired.

In such photographic processing wherein neither washing water nor cooling water is needed substantially, it has been possible to eliminate piping for supplying and draining liquids outside the processor, and thereby the drawbacks of a conventional automatic processor such as a large expense of construction work for piping, difficulty of movement of the processor after installation thereof, narrow space close to feet around the processor and an expense of energy for pressure for supplying warm water have been solved, providing an extremely great advantage that the processor can be made small and compact and further be simplified to the extent that it can be used as an office machine However, the waste liquids therefrom are extremely high in terms of a load for environmental pollution, and they are not allowed to be dumped into rivers and even into sewerages by regulations of environmental pollution because they are not diluted by water. Further, an amount of waste liquids discharged from such photographic processing (processing which does not require water washing done by a large amount of running water), though it may small, has reached an amount as high as 10 liters per day even in a relatively small photofinishing laboratory.

The waste liquids discharged from the photofinishing laboratory for color processing are usually collected by a waste liquid disposal company and are subjected to the secondary and tertiary treatment to be harmless. Due to a rise in collection expense, however, charge for collection of waste liquids rises year after year, and waste liquids can not be collected so frequently because of poor collection efficiency, resulting in a problem that the laboratory is filled with waste liquids.

Therefore, for easy disposal of waste liquids discharged from photographic processing at a small-sized photo-finishing laboratory, following two points are now being considered (1) to heat waste liquids so that the moisture may be evaporated and the waste liquids may be solidified (for example, Japanese Utility Model Published Application No.70841/1985 and (2) to use a heat-radiating unit and a heat-absorbing unit both of a heat pump circuit as a heating means for an evaporating vessel for evaporating and concentrating waste liquids and as a cooling means for a cooling vessel which cools, condenses and liquefies the vapor and to decompress the evaporating vessel and the cooling vessel with a decompressing means so that the liquids may boil under its normal boiling point, and to take out condensed liquids. Among the foregoing, (2) is more excellent than (1) on the point that it is possible to separate from condensate without generating hydrogen sulfide because of evaporation under reduced pressure.

However, even condensed liquids obtained by the above item (2) contains harmful substances such as, for example, ammonia, acetic acid and alcohol or the like, depending on the composition of processing solutions, and it has not been allowed to dump into rivers and others due to the problem of environmental pollution.

SUMMARY OF THE INVENTION

An object of the invention is to provide an automatic processing system for photographic use wherein substantial amount of replenisher can be reduced remarkably by condensing and desalting waste liquids in photographic processing and by supplying the desalted liquids into processing tanks. Further object of the invention is to provide an evaporation and concentration processor for water solution wherein effluent with good water quality can be obtained stably from the above-mentioned concentrated liquids so that the disposable water may be dumped into rivers and others and to provide a method for processing waste liquids in photographic processing wherein the aforementioned evaporation and concentration processor is employed.

In the first constitution of the invention for solving the above-mentioned problem, a photographic light-sensitive material is processed with processing solutions in processing tanks of an automatic processor, and processing solutions exhausted through processing are restored by replenisher chemical solution added to processing solutions so that continuous photographic processing may be carried out. The replenisher chemical solution to be supplied to the processing tanks are caused to be concentrated processing agent, and waste liquids in photographic processing discharged from processing steps in the automatic processor are heated by the evaporator/distillator processor to be evaporated and concentrated. Vapor generated from the aforementioned processing are cooled and condensed, and the condensed liquids are separated into electric dialysis concentrated liquids and desalted liquids by an electric dialysis device wherein cation exchange membranes and anion exchange membranes are arranged alternately through chamber frames between electrodes so that concentrating chambers and desalting chambers may be formed alternatively by both ion exchange membranes and chamber frames. The desalted liquids obtained from the aforesaid step are stored in a desalted liquid storage tank and supplied to the above-mentioned processing tanks.

In the second constitution of the invention, waste liquids in photographic processing of the aforementioned evaporator/distillator processor are heated to be evaporated and concentrated and vapor produced from the above step are cooled and condensed by a means which is equipped with a pressure reducing means wherein the aforesaid heat radiating unit and the heat absorbing unit both in a heat pump device including a compressor, a heat radiating unit, a pressure reducing device, and a heat absorbing unit all connected in succession wherein heat media are sealed hermetically are used as a heating means for an evaporating vessel for evaporating and concentrating the waste liquids in photographic processing mentioned above and as a cooling means for a cooling vessel for cooling and liquefying vapor, and the aforementioned evaporating vessel and the cooling vessel are in free communication for reducing pressure totally.

In the third constitution of the invention, concentrated processing agents to be supplied to at least one of processing steps mentioned above are supplied after being divided into two kinds or more.

In the fourth constitution of the invention, the concentrated processing agent mentioned above is supplied in a quantity ranging from 1/30 to 1/50 of the amount of desalted liquids to be supplied.

In the fifth constitution of the invention, the processing tank is provided with a liquid level detection means, and the desalted solution mentioned above is supplied based on the signals of liquid level detection.

In the sixth constitution of the invention, waste liquids in photographic processing discharged from two or more automatic processors mentioned above are subjected collectively to evaporation and concentration processing.

In the seventh constitution of the invention, waste liquids discharged from automatic processors for color negative films and those for color photographic papers are processed collectively, and desalted liquids produced from the processing are supplied to the aforementioned automatic processors for color negative films and those for color photographic papers.

In the eighth constitution of the invention, concentrated processing agents are used as replenisher chemical solution to be supplied to the processing tanks mentioned above, and an amount of each condensed processing agent is established so that supply of all concentrated processing agents to be supplied to a plurality of processing tanks may be completed almost simultaneously.

In the ninth constitution of the invention, the aforementioned electric dialysis concentrated liquid is supplied to processing steps in the automatic processor mentioned above.

In the tenth constitution of the invention, desalted liquids to be supplied to a step of washing or a step of waterless stabilizing both following a step of fixing among processing steps in the automatic processor are supplied separately from the replenishment for processing of light-sensitive materials when an amount of photographic light-sensitive materials to be processed in a certain period of time is small, which is a distinctive feature. In the eleventh constitution of the invention, a desalted liquid storage tank for the above-mentioned desalted liquid is equipped with a sterilizing means.

In the twelfth constitution of the invention, there is provided a waste liquid storage tank for storing of waste liquids in photographic processing discharged from the processing tanks, and the waste liquids are supplied to an evaporation and concentration processor from the waste liquid storage tank.

In the thirteenth constitution of the invention, a replenisher tank for storing of the concentrated processing agents is made to be capable of being set on a receiving portion of the processing tank, and the replenisher tank and the receiving portion of the processing tank are prepared to be the same in terms of a color or a shape for the setting.

Owing to the constitutions of the invention, it is possible to reduce remarkably a substantial amount of processing agents for replenishment by supplying desalted liquids obtained from the processing of waste liquids in photographic processing to processing tanks in the automatic processor. For example, in the case of a replenisher tank for processing agents for replenishment in the automatic processor having the same processing capacity as in a conventional one, it requires much less processing agents. In the case of a replenisher tank having the same capacity as in a conventional one, on the other hand, it requires much less frequent addition of processing agents for replenishment.

Further, when concentration of gas components contained in condensed liquid is controlled by an evaporator/distillator processor equipped with a heat pump unit, it is possible to reduce remarkably the substantial amount of replenishment for processing agents for replenishment without being influenced by change in components of processing solutions caused by variation of in various kinds of photographic processing solutions and processing quantity. Namely, it is possible to reduce the load for an electric dialysis tank for its stable operation by controlling gas generation caused by decomposition due to heating and evaporation and controlling concentration itself of gas components entering condensed liquids. Further, it is possible to prevent components of substances in question from entering desalted water to be supplied in processing solutions.

Further, concentrated processing agents to be supplied to at least one processing step in an automatic processor are divided into two or more kinds to be supplied. When concentrated processing agents are divided as in the foregoing, stability of the processing agents is improved and stability of the system is also enhanced. It is also possible to stabilize processing solutions to which preservatives and desalted liquids are supplied, with preservative components being one part.

In addition, concentrated processing agents are supplied in quantity ranging from one-third to one-fiftieth of desalted water to be supplied. For example, when an amount of concentrated processing agents is excessive for desalted liquids, the effect of the invention is lowered and when it is insufficient, the processing capability is not stable, resulting in the preferable range from one-third to one-fiftieth of desalted water.

Moreover, a liquid level detection means is provided on a processing tank, and desalted liquids are supplied based on the signals of the liquid level detection to cope with variation caused by evaporation with the passage of time.

Waste liquids in photographic processing discharged from two or more automatic processors are subjected collectively to evaporation and concentration processing, when a system is organized by two or more automatic processors, it is advantageous in terms of a floor space and cost, and desalting may be stabilized.

Again, waste liquids discharged from automatic processors for color negative films and those for color photographic papers are processed collectively, and desalted liquids produced from the processing are supplied to the aforementioned automatic processors for color negative films and those for color photographic papers. Therefore, both processing of negative films and processing of papers are used in a form of a pair as a system in a mini-lab, and when the system is united in one, it proves to be a stable one which is not time-consuming and is easily maintained. Concentrated processing agents are used as replenisher chemical solution to be supplied to the processing tanks, and an amount of each concentrated processing agent is established so that supply of all concentrated processing agents to be supplied to a plurality of processing tanks may be completed almost simultaneously, resulting in a simple handling wherein all condensed processing agents can be replaced collectively.

Electric dialysis concentrated liquids supplied to processing steps in an automatic processor contain preservatives components for processing solution to maintain capability of processing solutions and to stabilize processing for the lapse of time. Further, electrode liquid can be used as a pH-adjusting agent.

Desalted liquids to be supplied to a step of washing or a step of waterless stabilizing both following a step of fixing among processing steps in the automatic processor are supplied separately from the replenishment for processing of light-sensitive materials when an amount of photographic light-sensitive materials to be processed in a certain period of time is small, resulting in stabilized processing which is free from problems of exposure unevenness and those in finishing of white background on a light-sensitive material.

A desalted liquid storage tank is equipped with a sterilizing means, and thereby a damage of desalted liquid caused by microbes can be prevented.

There is provided a waste liquid storage tank for storing of waste liquids in photographic processing discharged from the processing tanks, and the waste liquids are supplied to an evaporator/distillator processor from the waste liquid storage tank. Storage in the waste liquid storage tank serves as a buffer which can support the system having small processing capacity.

A replenisher tank for the storage of concentrated processing agents and the receiving portion of the processing tank are prepared to be the same in terms of a color and/or a shape for the setting, and erroneous operation can be prevented through a simple constitution.

With regard to the fourteenth constitution of the invention for attaining the above-mentioned object, in an evaporator/distillator processor wherein a heat-radiating unit and a heat-absorbing unit both of a heat pump circuit wherein a compressor, a heat-radiating unit, a pressure reducing device and a heat-absorbing unit are connected in succession and heat media are sealed are used as a heating means for an evaporating vessel for evaporation and concentration and as a cooling means for a cooling vessel which cools vapor for condensation and liquefaction, and the evaporating vessel and the cooling vessel are connected on a free communication basis so that an entire system may be decompressed by a vacuum pump, a condensed water outlet on the cooling vessel mentioned above is connected to an activated-sludge processing means so that condensed water may be subjected to biological processing. In this case, a condensed water cooling unit may be provided between the condensed water outlet on the cooling vessel and the activated-sludge processing means. When a water solution to be concentrated is waste liquid in photographic processing, evaporated and separated condensed water is either subjected to activated-sludge processing conducted by means of microbes for treatment of raw sewage used as an initial sludge, or it is guided to an activated-sludge processing facility which is commonly used for raw sewage.

Owing to the constitution mentioned above, condensed water taken out of the bottom of the cooling vessel is guided to an aeration tank where it is aerated by air supplied by a blower, and then is precipitated in the following tank from where supernatant liquid is drained. In this case, when a condensed water cooling unit is provided between the condensed water outlet on the cooling vessel and the activated-sludge processing means, a deodolizing effect for condensed water is excellent and the present equipment can be used in a small-sized color photo-finishing laboratory when water solution to be concentrated is waste liquid in photographic processing. Since evaporated and separated condensed water contains an ammonia group, it can be processed more effectively if evaporated and separated condensed water is either subjected to activated-sludge processing conducted by means of microbes for treatment of raw sewage used as an initial sludge, or it is guided to an activated-sludge processing facility which is commonly used for raw sewage.

DETAILED DESCRIPTION OF THE PREFERRED EMBODIMENTS

The invention will be explained in detail as follows.

Figure 1:
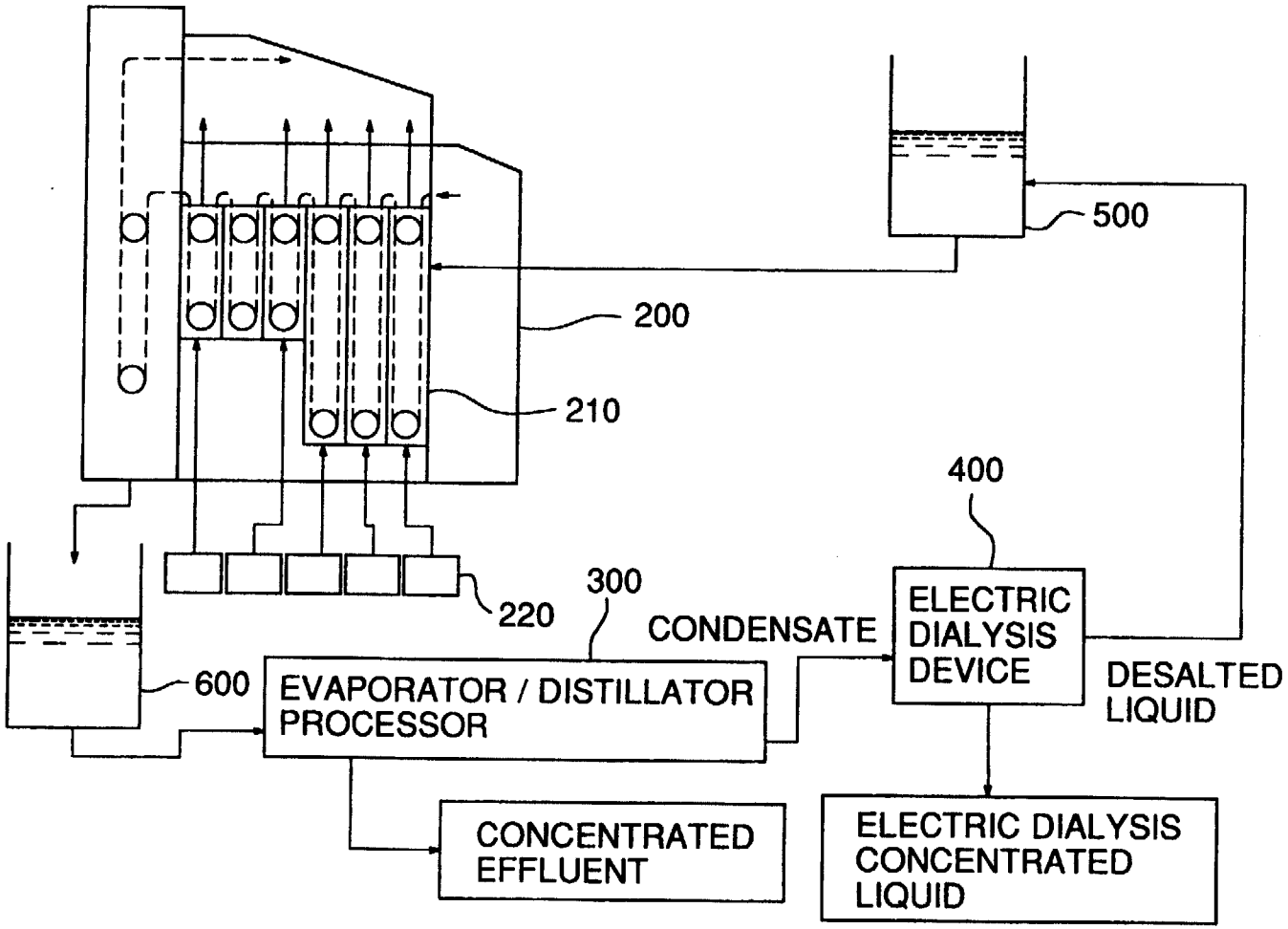
FIG. 1 is a schematic block diagram of an automatic processor for photographic use.

The automatic processing system for photographic use is shown in FIG. 1. In the automatic processing system for photographic use, a photographic light-sensitive material is processed with processing solutions in processing tanks 210 of automatic processor 200, and processing solutions exhausted through processing are restored by replenisher chemical solution added from replenisher tank 220 to processing solutions so that continuous photographic processing may be carried out. The replenisher chemical solution to be supplied to the processing tanks 210 are caused to be concentrated processing agent, and waste liquids in photographic processing discharged from processing steps in the automatic processor 200 are heated by the evaporator/distillator processor 300 to be evaporated and concentrated. Vapor generated from the aforementioned processing are cooled and condensed, and this condensed liquids are separated into electric dialysis concentrated liquids and desalted liquids by electric dialysis device 400 wherein cation exchange membranes and anion exchange membranes are arranged alternately through chamber frames between electrodes so that concentrating chambers and desalting chambers may be formed alternatively by both ion exchange membranes and chamber frames. The desalted liquids obtained from the aforesaid step are stored in a desalted liquid storage tank 500 and supplied to the above-mentioned processing tanks 210, which is a distinctive feature.

In this automatic processing system for photographic use, it is possible to reduce remarkably a substantial amount of processing agents for replenishment by supplying desalted liquids obtained from the processing of waste liquids in photographic processing to processing tanks 210 in the automatic processor 200. For example, therefore, in the case of replenisher tank 220 for replenisher chemical solution in the automatic processor having the same processing capacity as in a conventional one, it requires much less processing agents. In the case of a replenisher tank having the same capacity as in a conventional one, on the other hand, it requires much less frequent addition of processing agents for replenishment.

The constitution of the automatic processing system for photographic use will be explained in detail as follows.

AUTOMATIC PROCESSOR

There is no restriction in a kind of waste liquid in photographic processing which is to be processed in the invention, but those discharged from an automatic processor are preferable. It is further preferable that an evaporator/distillator processor and an electric dialysis device both in the invention are either built in an automatic processor or are provided in the vicinity of the automatic processor with pipes for waste liquids provided.

An automatic processor may be of an any kind and type, including, for example, one wherein a photographic light-sensitive material of a roll type is guided continuously through a color developing tank, a bleach-fixing tank and a washing-substituting stabilizing tank for photographic processing and then is taken up after being dried. Another type of an automatic processor is equipped with a color developing tank, a bleaching tank, a fixing tank, a washing-substituting tank and a second stabilizing tank, wherein a photographic light-sensitive material is guided by a short leader.

An automatic processor is usually provided with replenisher tanks, and an amount of photographic light-sensitive materials processed in the automatic processor is detected by a sensor so that a controlling device may replenish a replenisher to each processing tank in the processor based on the detection information.

With regard to application of the invention, there is no restriction in terms of a photographic processing method, constitution of photographic processing tanks and a method for replenishing a replenisher, and the invention can also be applied, for example, to those of other types and constitution including those of a waterless type disclosed in U.S. Pat. No. 4,939,073, Japanese Patent Publication Open to Public Inspection (hereinafter "Japanese Patent O.P.I. Publication") No. 34448/1983.

Typical examples of waste liquids in photographic processing which can be processed in the invention are disclosed in detail in Japanese Patent O.P.I. Publication No. 201442/1987, for example. In Japanese Patent O.P.I. Publication No. 201442/1987, however, photographic processing solutions in the case of color photographic light-sensitive materials to be processed are described. As waste liquids in photographic processing, overflowed liquids generated when processing silver halide photographic light-sensitive materials by using photographic processing solutions are used. In particular, when thiosulfate ions are contained, the invention shows its sufficient effect and when the thiosulfate ions are contained at the rate of 20 g/liter or more, the invention shows more sufficient effect.

COLLECTION OF WASTE LIQUIDS IN PHOTOGRAPHIC PROCESSING

When a replenisher is replenished to each processing tank in an automatic processor, overflowed waste liquids discharged from a processing tank are collected in a storage tank. In an ordinary automatic processor, liquids overflowing from the top of a processing tank being caused by replenishment of a replenisher are processed as waste liquids in photographic processing.

The invention also includes that a plurality of storage tanks are provided and that a plurality of evaporator/distillator processors of the invention are provided and one or two of them are used as a storage tank (for example, the same processor is used as a storage tank and a processor alternatively). When light-sensitive materials in a certain amount are processed at a time by the use of a storage tank, it is possible to make components of waste liquids in photographic processing uniform, and the storage tank is useful as a buffer from a photographic processing tank to an evaporator/distillator processor.

As a means for pouring overflowed waste liquids in photographic processing into a storage tank, a method wherein a guide pipe is used for natural falling of the waste liquids is a simple way, but a means wherein a heat exchange device is located on the half way of the course of the waste liquids to catch heat energy owned by waste liquids in photographic processing, or waste liquids in photographic processing are heated preliminarily by the use of heat energy of the automatic processor or of an evaporator/distillator processor described later before being collected into the storage tank, or moisture is evaporated can be used, and also a method wherein waste liquids are forced to run by a pump can be used.

Since components of waste liquids in photographing processing in each photographic processing tank of an automatic processor differ from each other, the invention includes also an occasion wherein all waste liquids in photographic processing are not processed collectively but are processed for each processing tank separately or processed separately after being grouped into two or more storage tanks provided for the groups of processing tanks in the same number. In particular, it is advantageous, from a viewpoint of silver recovery, to separate waste liquids in a color developing tank from those in a bleach-fixing tank and a washing-substituting stabilizing tank.

In the invention, it is preferable to process waste liquids in photographic processing wherein waste liquids in photographic processing coming from processing of negative films and those coming from processing of photographic papers are mixed.

It is further possible to employ a method wherein pipes are arranged on an existing tank for waste liquids in an automatic processor or the like, and waste liquids are forced by a pump to run into a storage tank It is further possible to use a tank for waste liquids in an automatic processor as a storage tank. In this case, it is preferable to detect weight of the storage tank to operate the pump so that waste liquids are forced to run through the pipes. Another method wherein a float is set afloat in a tank for waste liquids to detect a liquid level higher than a certain level for operating a pump is preferable because it is simple to install on an existing automatic processor.

With regard to waste liquids in photographic processing to be subjected to distillation and concentration processing in the invention, pH value thereof may be as it is, but evaporation processing at pH 3.5–7, especially at pH 4.5–6.5 is preferable to attain more effectively the object of the invention. Further, the use of various kinds of antifoaming agents (for example, silicone compounds or the like) is extremely advantageous because it is possible to inhibit foaming in the course of evaporation processing caused by activating agents which exist in photographic processing solutions or liquate out of light-sensitive materials.

Figure 2:
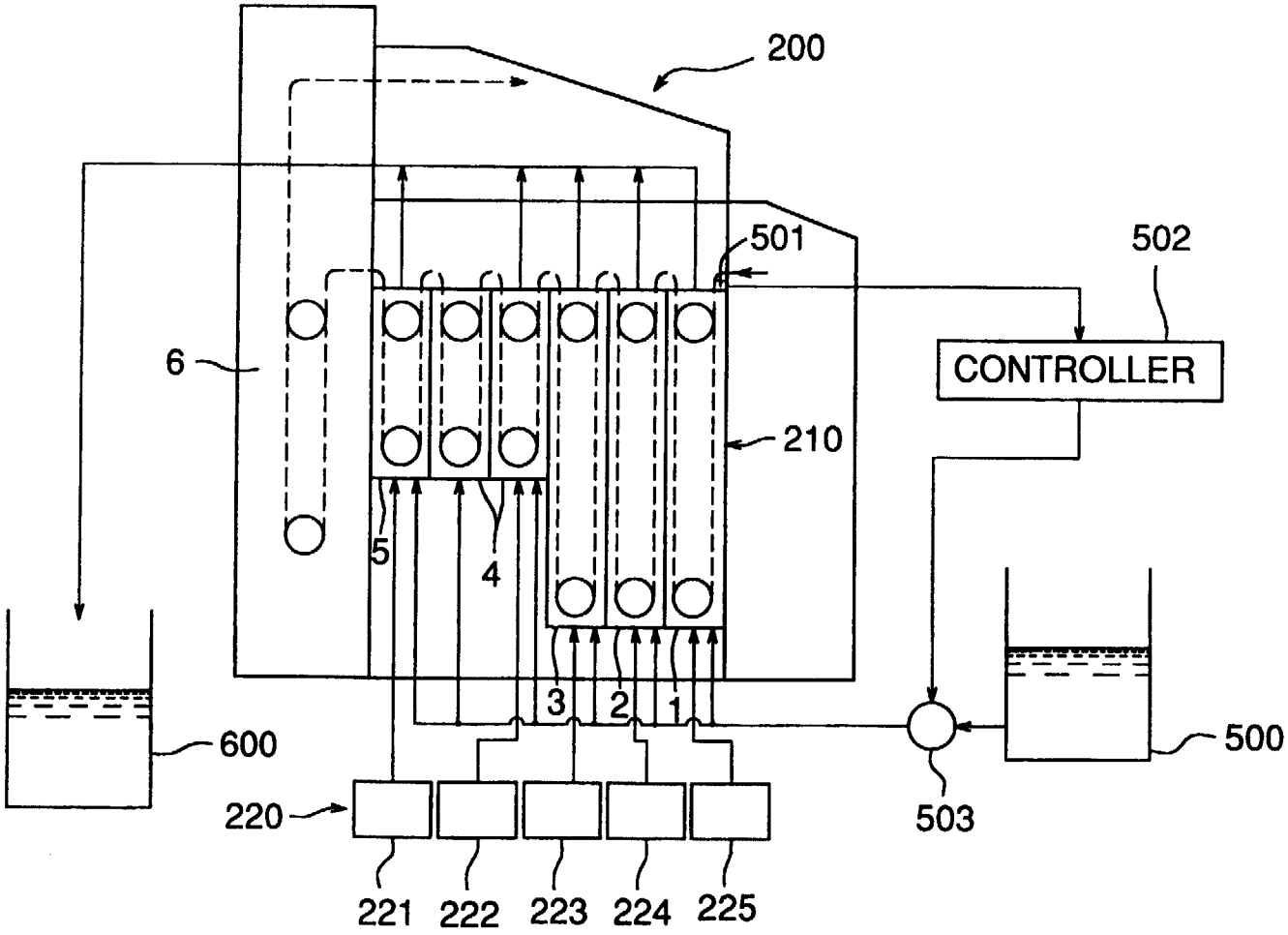
FIG. 2 is a schematic block diagram of an automatic processor for color negative films.
Figure 3:
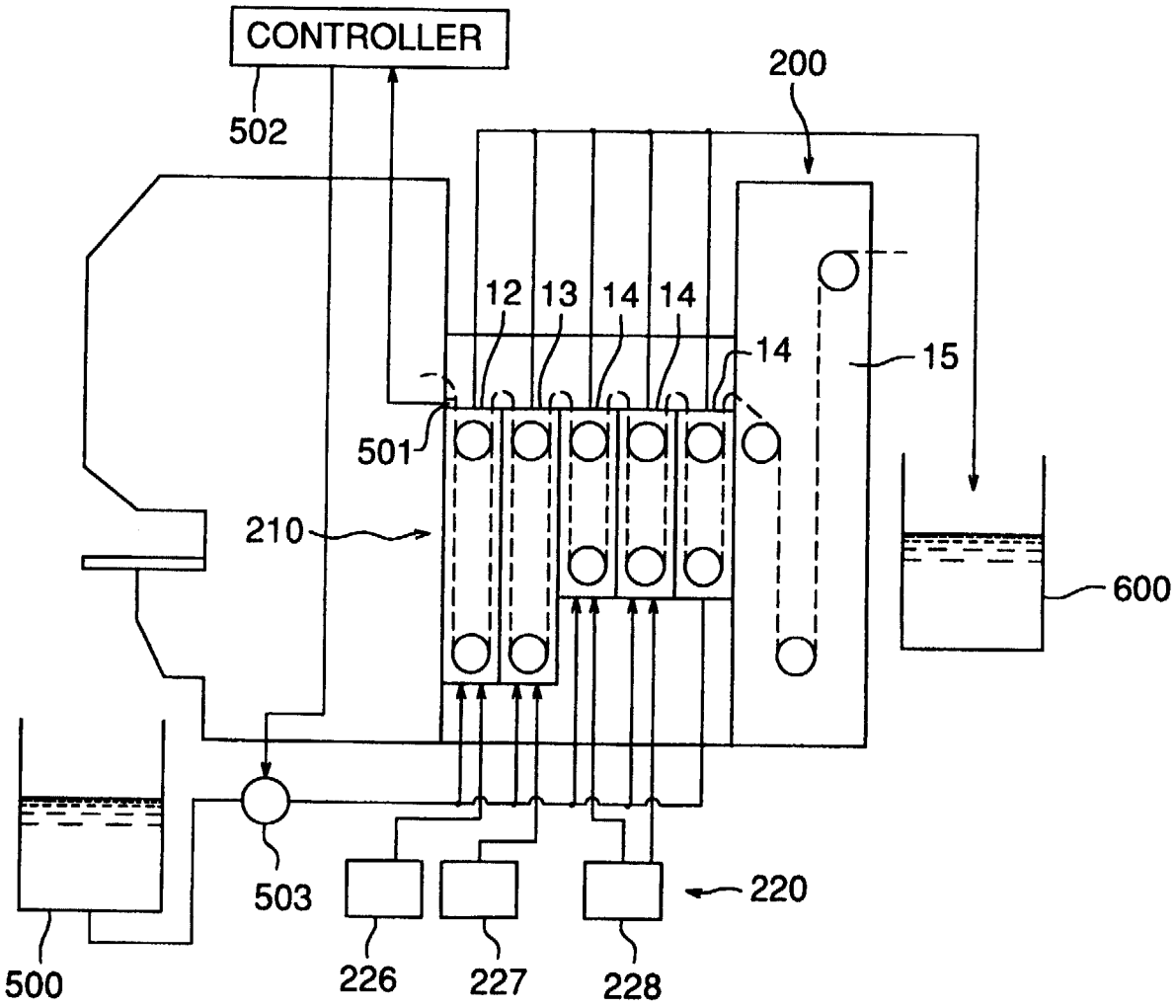
FIG. 3 is a schematic block diagram of an automatic processor for color photographic papers.
Figure 4:
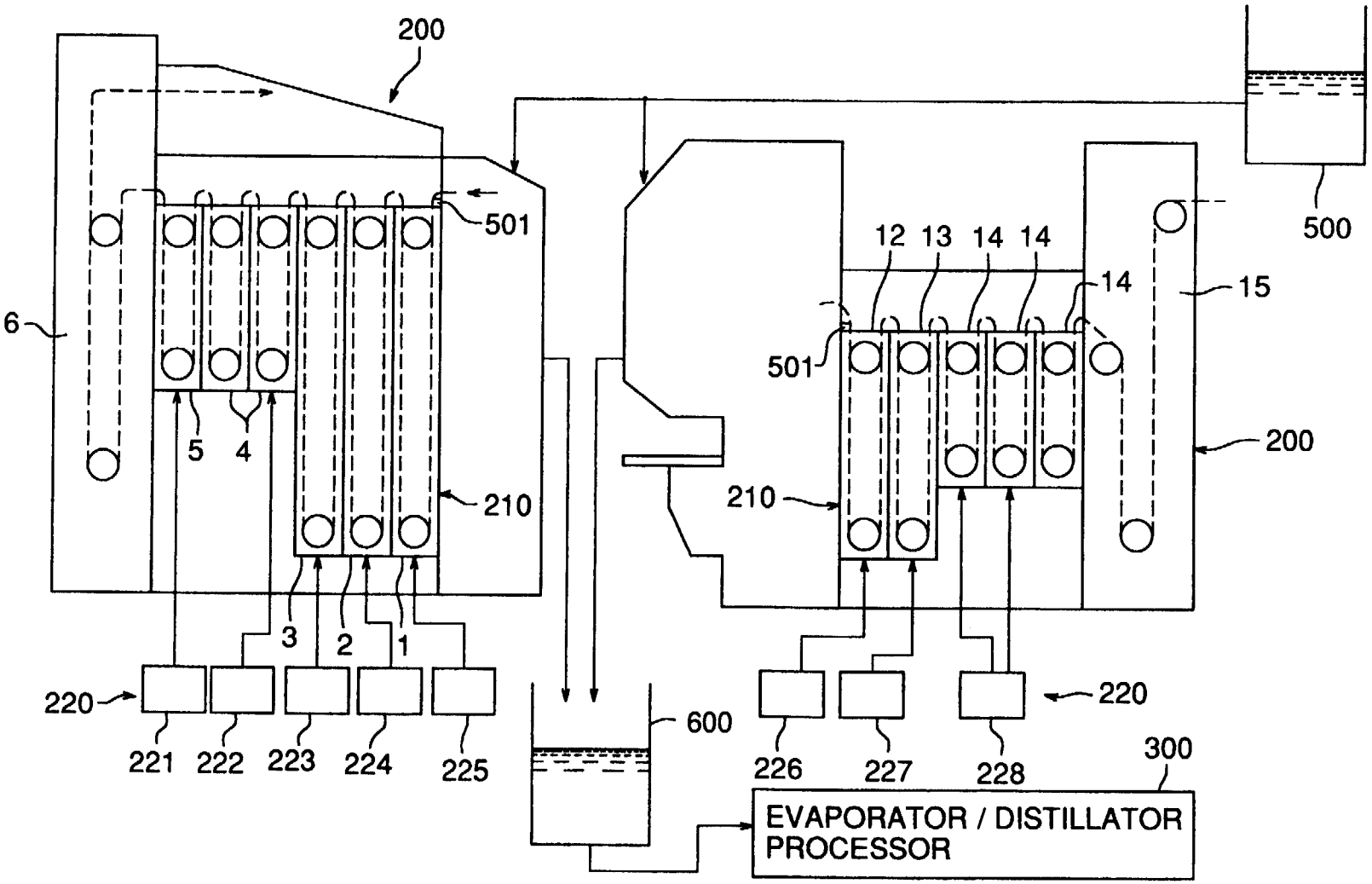
FIG. 4 is a schematic block diagram of an automatic processing system for photographic use comprising an automatic processor for color negative films and an automatic processor for color photographic papers.

Each of FIGS. 2 and 3 shows an example of an automatic processor. FIG. 2 shows an automatic processor for processing color negative films wherein processing tanks such as color developing tank 1, bleaching tank 2, fixing tank 3, washing-substituting stabilizing tank 4 and second stabilizing tank 5 are provided, and processed photographic light-sensitive materials are dried in drier section 6. To each of the color developing tank 1, bleaching tank 2, fixing tank 3, washing-substituting stabilizing tank 4 and second stabilizing tank 5, each of replenisher tanks 221–225 is connected and waste liquids in photographic processing overflowing from the color developing tank, bleaching tank 2, fixing tank 3, washing-substituting stabilizing tank 4 and second stabilizing tank 5 are stored in waste liquid storage tank 600.

FIG. 3 shows an automatic processor for processing color photographic papers wherein processing tanks such as color developing tank 12, bleach-fixing tank 13, and washing-substituting stabilizing tank 14 are provided, and processed photographic light-sensitive materials are dried in drier section 15. To each of the color developing tank 12, bleach-fixing tank 13, and washing-substituting stabilizing tank 14, each of replenisher tanks 226–228 is connected and waste liquids in photographic processing overflowing from the color developing tank 12, bleach-fixing tank 13, and washing-substituting stabilizing tank 14 are stored in waste liquid storage tank 600.

Waste liquids in photographic processing discharged from these processing tanks are stored in waste liquid storage tank 600, and the waste liquids are supplied from the waste liquid storage tank 600 to evaporator/- distillator processor 300, thus the waste liquid storage tank 600 serves as a buffer and backs up a system having a small processing capacity.

Further, concentrated processing agents to be supplied to at least one processing step in an automatic processor are divided into two or more kinds to be supplied, and when concentrated processing agents are divided as in the foregoing, stability of the processing agents is improved and stability of the system is also enhanced. It is also possible to stabilize processing solutions to which preservatives and desalted liquids are supplied, with preservative components being one part.

In addition, concentrated processing agents are supplied in quantity ranging from one-third to one-fiftieth of desalted liquid to be supplied from desalted liquid storage tank 500. For example, when an amount of concentrated processing agents is excessive for desalted liquids, the effect of the invention is lowered and when it is insufficient, the processing capability is not stable, resulting in the preferable range from one-third to one-fiftieth of desalted liquid.

Moreover, liquid level detection means 501 is provided on a processing tank, and control device 502 drives pump 503 to supply desalted liquids from desalted liquid storage tank 500 based on the signals of the liquid level detection to cope with variation caused by evaporation with the passage of time.

Waste liquids in photographic processing discharged from two or more automatic processors 200 are supplied to evaporator/distillator processor 300 and subjected collectively to evaporation and concentration processing, when a system is organized by two or more automatic processors 200, it is advantageous in terms of a floor space and cost, and desalting may be stabilized.

Again, waste liquids discharged from automatic processors for color negative films and those for color photographic papers are processed collectively, and desalted liquids produced from the processing are supplied to the aforementioned automatic processors for color negative films and those for color photographic papers. Therefore, both processing of negative films and processing of papers are used in a form of a pair as a system in a mini-lab, and when the system is united in one, it proves to be a stable one which is not time-consuming and is easily maintained.

When concentrated processing agents are used as replenisher chemical solution to be supplied to the processing tanks, and when an amount of each concentrated processing agent is established so that supply of all condensed processing agents to be supplied to a plurality of processing tanks may be completed almost simultaneously, all condensed processing agents can be replaced collectively, resulting in a simple handling.

Desalted liquids which are obtained by electric dialysis device 400 and supplied to processing steps in an automatic processor 200 as shown in FIG. 1 contain preservatives components for processing solution to maintain capability of processing solutions and to stabilize processing for the lapse of time. Further, electrode liquid can be used as a pH-adjusting agent.

Desalted liquids to be supplied to a step of washing or a step of waterless stabilizing both following a step of fixing among processing steps in the automatic processor 200 are supplied separately from the replenishment for processing of light-sensitive materials when an amount of photographic light-sensitive materials to be processed in a certain period of time is small, resulting in stabilized processing which is free from problems of exposure unevenness and those in finishing of white background on a light-sensitive material.

A desalted liquid storage tank 500 is equipped with a sterilizing means, and owing to the sterilizing means, a damage of desalted liquid caused by microbes can be prevented.

Effective sterilizing means include ultraviolet sterilization (sterilization by means of a UV lamp having a length of 253.7 mm), electrolytic sterilization (carbon materials such as activated carbon, carbon fiber or porous carbon are used as a material for an anode and voltage ranging from 1.0 V to 10 V is impressed, and further, the aforementioned carbon materials are polarized in liquid so that they may act as an anode for electric sterilization) and a method of adding a sterilizer.

As a sterilizing means, those described in "Science of germ-protection and mildew-protection" published by Sankyo Publishing Co. and "New sterilizer and sterilizing technology" published by Toray Research Center Co. may be used. Especially preferable means include a ultraviolet sterilizing means, an electrolytic sterilizing means and a sterilizing means of adding halogenides (sterilizers and others).

Halogenides, in this case, include hypochlonous acid of chlorine compounds, isocyanuric acid and bromine compounds. Sterilizers used preferably include salicylic acid, sorbic acid, dehydro-acetic acid, hydroxy benzoic acid compounds, alkylphenol compounds, thiazole compounds, pyridine compounds, guanidine compounds, morpholine compounds, quaternary phosphonium compounds, ammonium compounds, urea compounds, isoxazole compounds, propanolamine compounds, sulfamide derivatives and amino acid compounds.

A replenisher tank 220 for the storage of concentrated processing agents and the receiving portion of the processing tank 210 are prepared to be the same in terms of a color and/or a shape for the setting, and erroneous operation can be prevented through a simple constitution.

Figure 5:
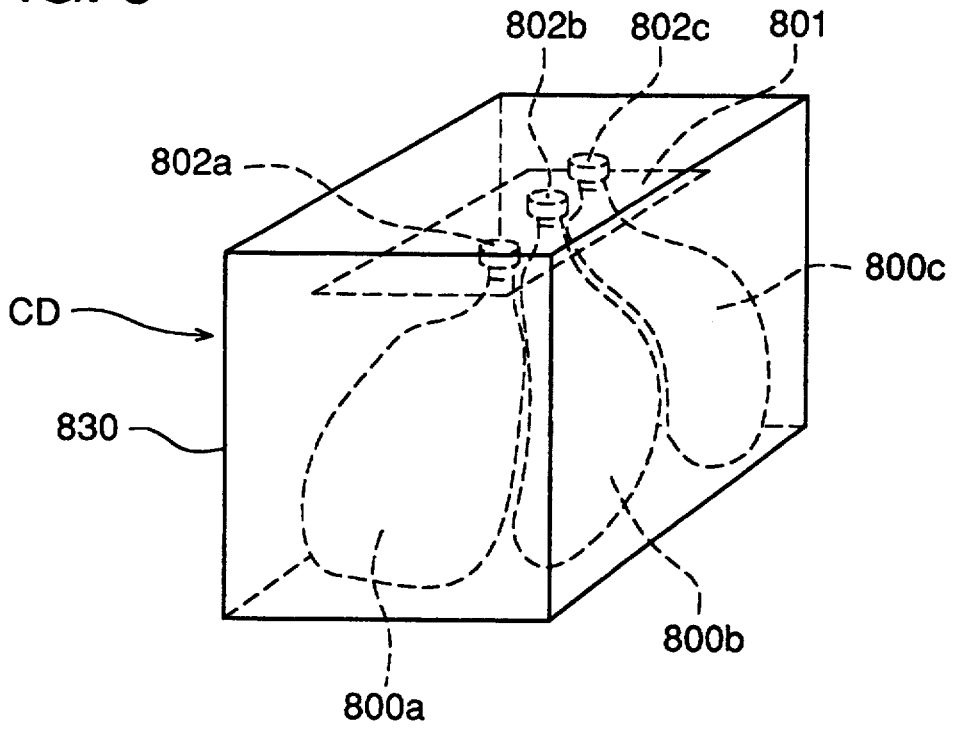
FIG. 5 is a perspective view of a replenisher tank.
Figure 6:
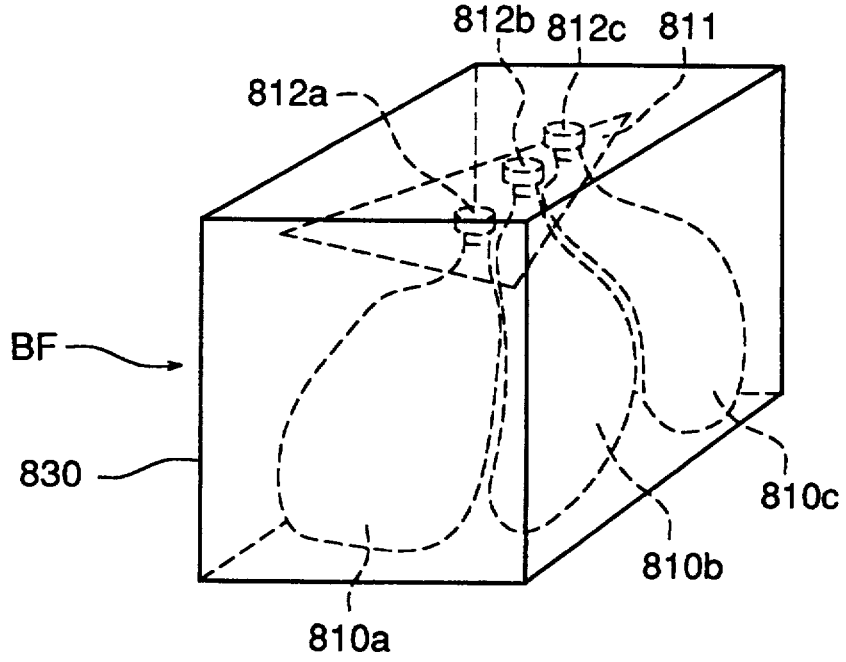
FIG. 6 is a perspective view of a replenisher tank.
Figure 7:
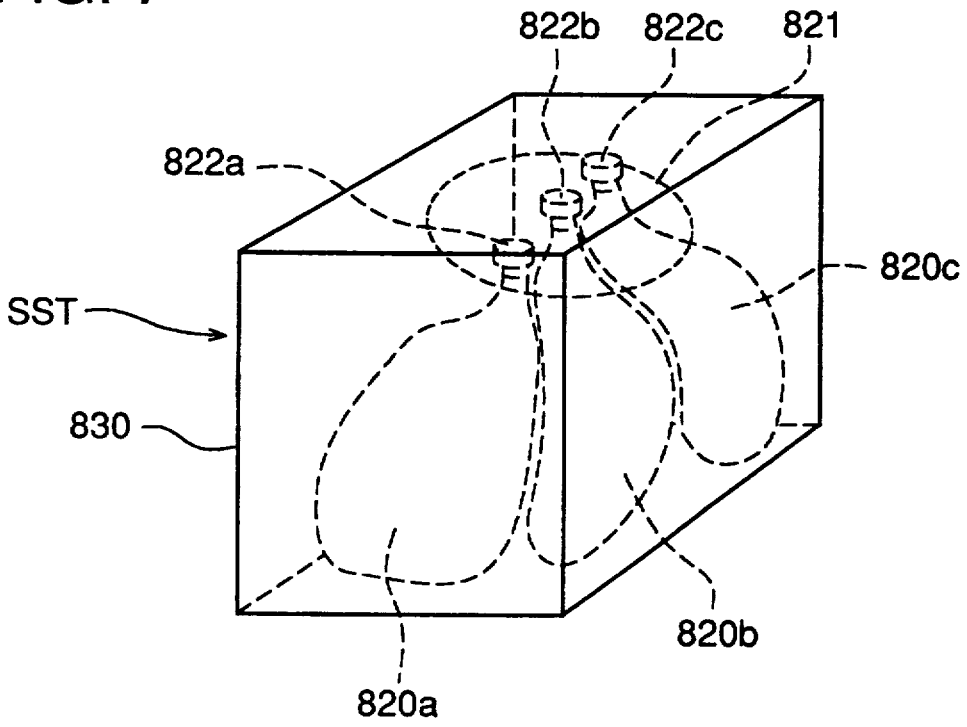
FIG. 7 is a perspective view of a replenisher tank.

The present examples will be explained as follows, referring to FIG. 5 through FIG. 10. In the examples, a replenisher tank in which concentrated processing agents are stored includes color developer container CD, blix container BF and waterless stabilizer container SST as shown in FIGS. 5–7, for example. Each of these color developer container CD, blix container BF and waterless stabilizer container SST is a flexible container which is a vinyl bag made of film having a low air-permeability, and three of them are prepared for each processing step.

Liquid-inlets 802*a*, 802*b* and 802*c* of three vinyl bags 800*a*, 800*b* and 800*c* which form the color developer container CD are supported by square supporting plate 801, liquid-inlets 812*a*, 812*b* and 812*c* of three vinyl bags 810*a*, 810*b* and 810*c* which form the blix container BF are supported by triangular supporting plate 811, and liquid-inlets 822*a*, 822*b* and 822*c* of three vinyl bags 820*a*, 820*b* and 820*c* which form the waterless stabilizer container SST are supported by round supporting plate 821, and each of the containers are packed in a cardboard box. In this example, the color developer container CD, blix container BF and waterless stabilizer container SST are identified respectively by means of shapes of the supporting plates 801, 811 and 821, but the containers may be the same in shape provided that their colors are different from each other, such as white, red, blue, green or hellow, for example.

Figure 8:
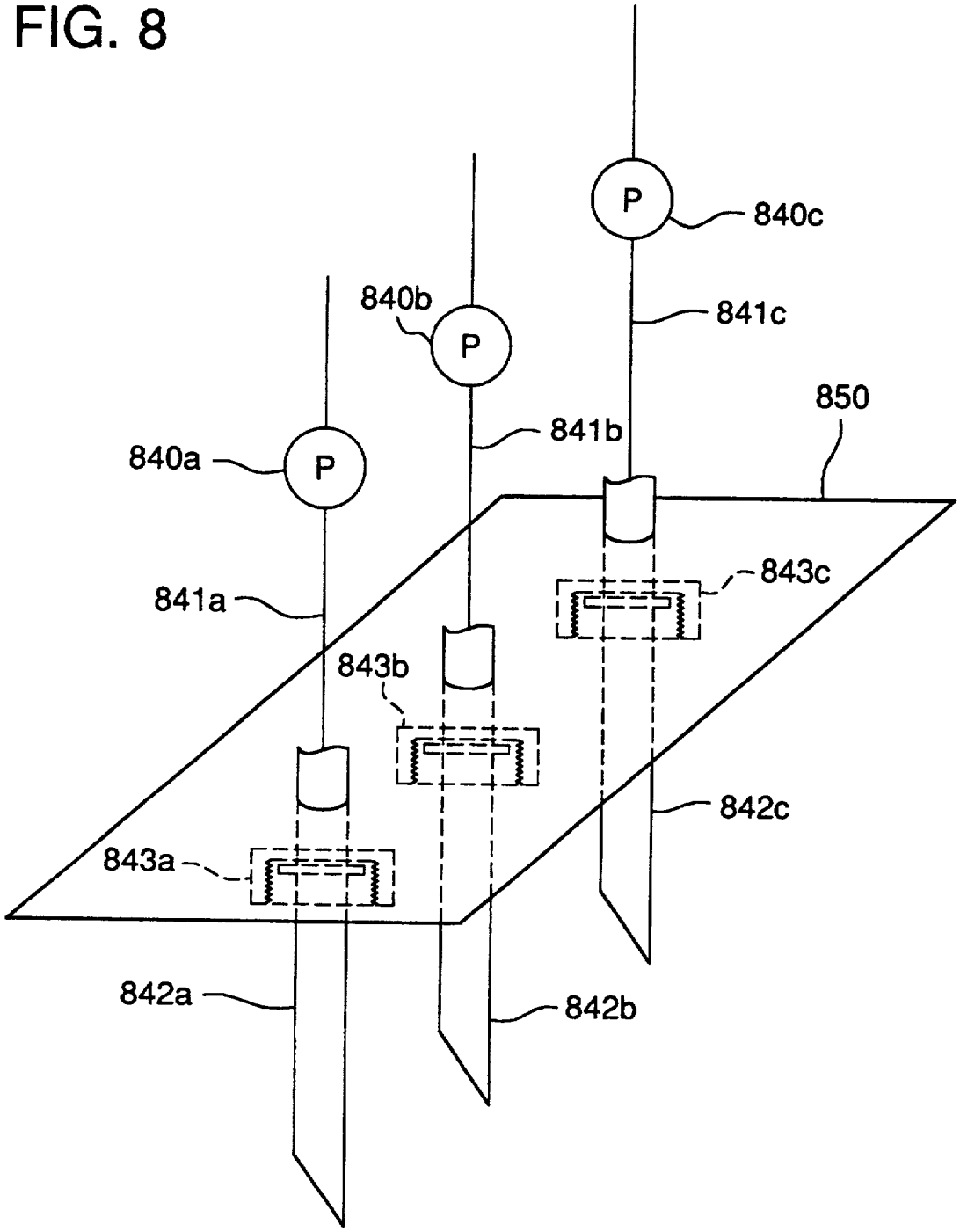
FIG. 8 is a perspective view showing how a replenisher tank is connected to a receiving portion of a processing tank.
Figure 9:
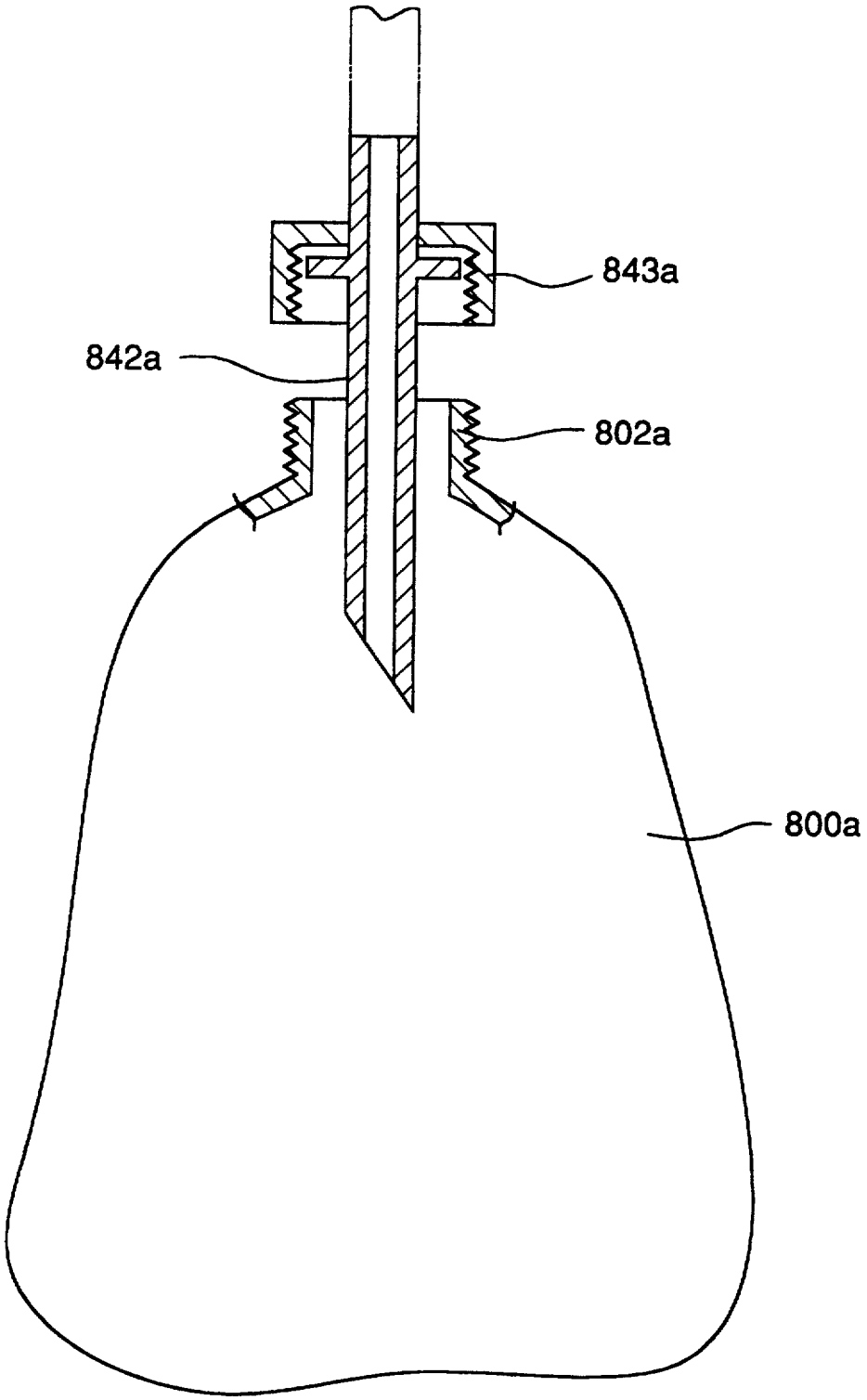
FIG. 9 is a sectional view showing how a replenisher tank is connected to a receiving portion of a processing tank.
Figure 10:
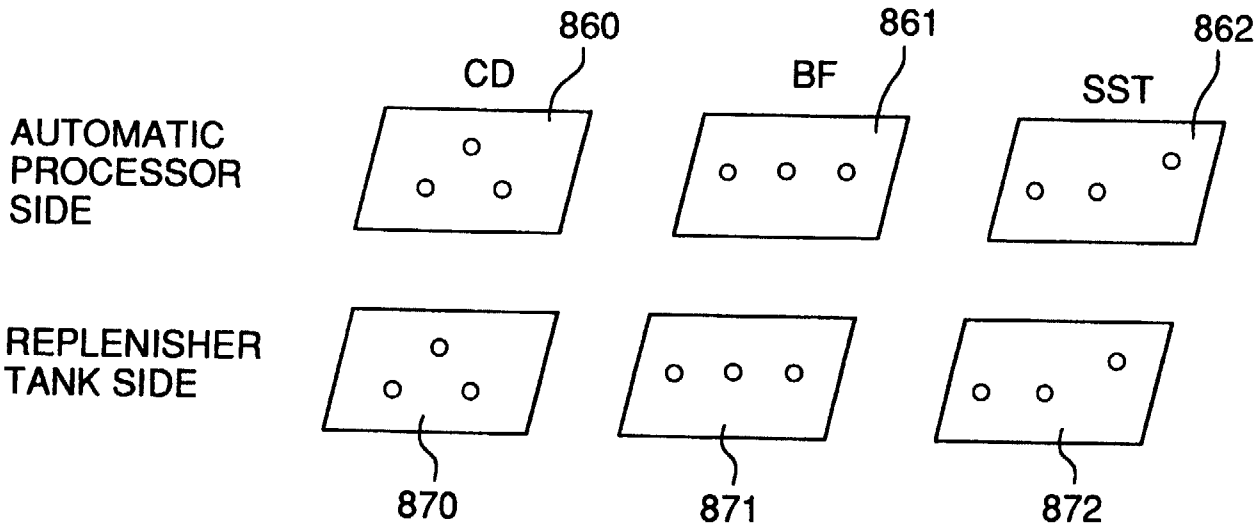
FIG. 10 is a perspective view showing a supporting plate for connection between a replenisher tank and a receiving portion of a processing tank.

The containers mentioned above are set on an automatic processor, and when setting the color developer container CD on the automatic processor, for example, color developer container CD is taken out of cardboard box 830, caps of liquid-inlets 802*a*, 802*b* and 802*c* are removed, and tip portions 842*a*, 842*b* and 842*c* of hoses 841*a*, 841*b* and 841*c* connected respectively to bellows pumps 840*a*, 840*b* and 840*c* located at the side of a color developing tank of the automatic processor are caused to point respectively to three vinyl bags 800*a*, 800*b* and 800*c* of the color developer container CD, as shown in FIGS. 8 and 9.

The caps 843*a*, 843*b* and 843*c* are screwed respectively into liquid-inlet portions 802*a*, 802*b* and 802*c* for free communication between the hoses and vinyl bags. In this case, each of caps 843*a*, 843*b* and 843*c* can be caused to match with each of liquid-inlet portions 802*a*, 802*b* and 802*c* by means of, for example, the same color or label on the cap and the liquid-inlet portion.

As a means for causing a replenisher tank for storage of concentrated processing agents to be in line with a receiving portion of a processing tank for setting, supporting plates 860, 861 and 862 respectively of color developer container CD, blix container BF and waterless stabilizer container SST can be arranged to be in line respectively with supporting plates 870, 871 and 872 of receiving portions on the side of a processing tank for connection.

Figure 11:
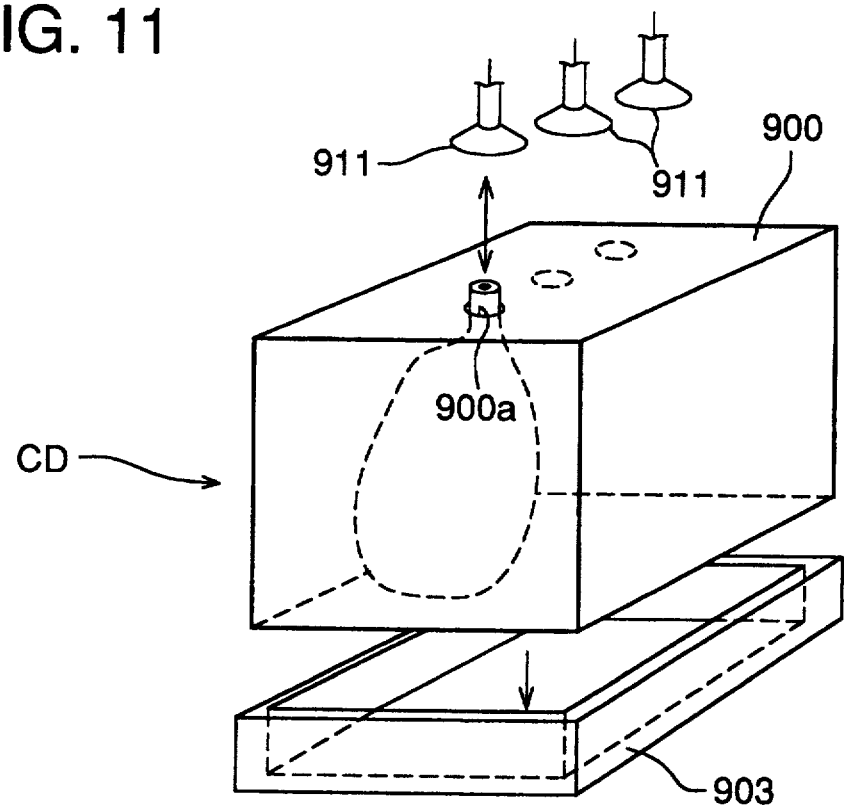
FIG. 11 is a sectional view showing a supporting plate for connection between a replenisher tank and a receiving portion of a processing tank.
Figure 12:
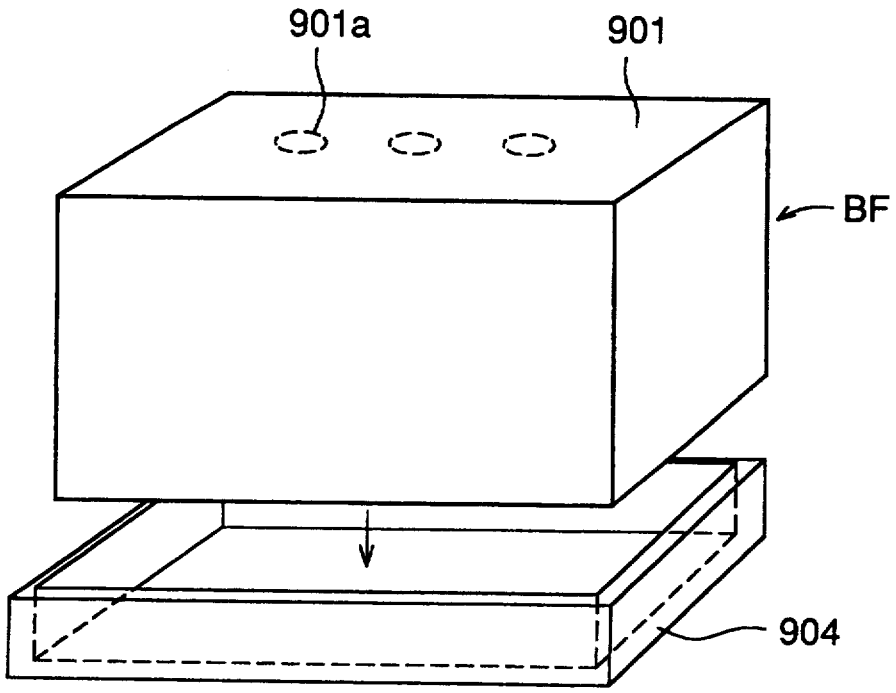
FIG. 12 is a sectional view showing a supporting plate for connection between a replenisher tank and a receiving portion of a processing tank.
Figure 13:
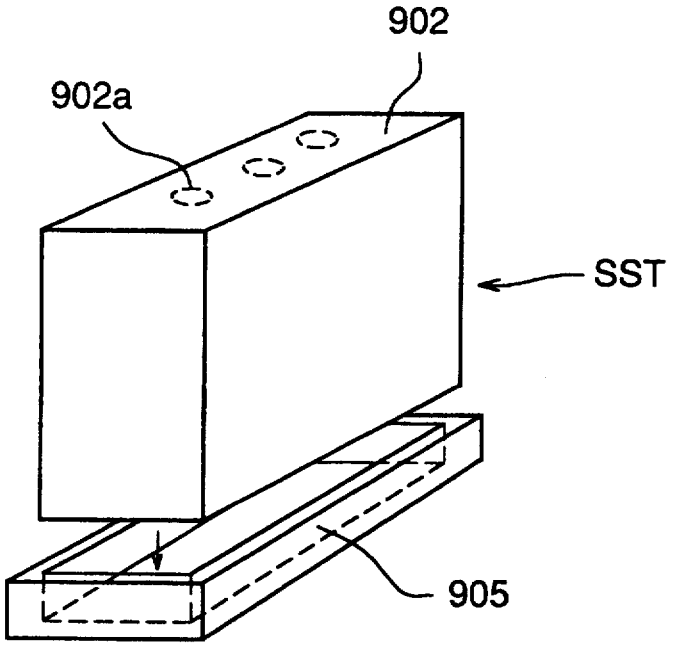
FIG. 13 is a sectional view showing a supporting plate for connection between a replenisher tank and a receiving portion of a processing tank.

Other examples of setting replenisher tank 220 for storage of the aforementioned concentrated processing agents to a receiving portion of processing tank 210 are shown in FIGS. 11–13. In these examples, color developer container CD, blix container FB and waterless stabilizer container SST, for example, are constituted as in the foregoing, but cases 900, 901 and 902 are different from each other in shape. On the side of an automatic processor, there are provided receiving portions 903, 904 and 905 which correspond respectively to the cases mentioned above, thus the color developer container CD, blix container BF and waterless stabilizer container SST are set respectively to the predetermined positions.

As a means for setting the color developer container CD, blix container BF and waterless stabilizer container SST respectively to their predetermined positions, a color or a label for each of receiving portions 903, 904 and 905 may be caused to be the same as that for each of the above-mentioned containers.

For the connection of the foregoing with processing tanks of an automatic processor, a hole is made on portions 900*a*–902*a* of the cases 900–902 for the color developer container CD, blix container BF and waterless stabilizer container SST, and then liquid-inlet portion 910 is taken out to be connected to hose 910 which is connected to the processing tank on a basis of free communication basis by means of a single-touch coupler. Even in this case, portions to be connected can match each other through a shape, a color or a label. It is preferable that a container for concentrated replenisher processing solution is used as a replenisher tank without taking any action.

Figure 14:
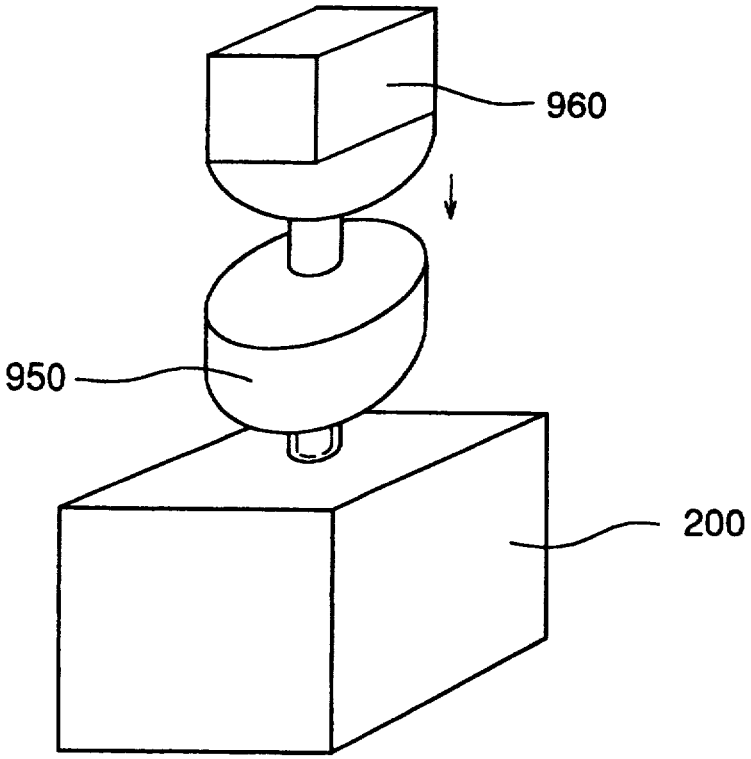
FIG. 14 is a sectional view showing a supporting plate for connection between a replenisher tank and a processing agent container.
Figure 15:
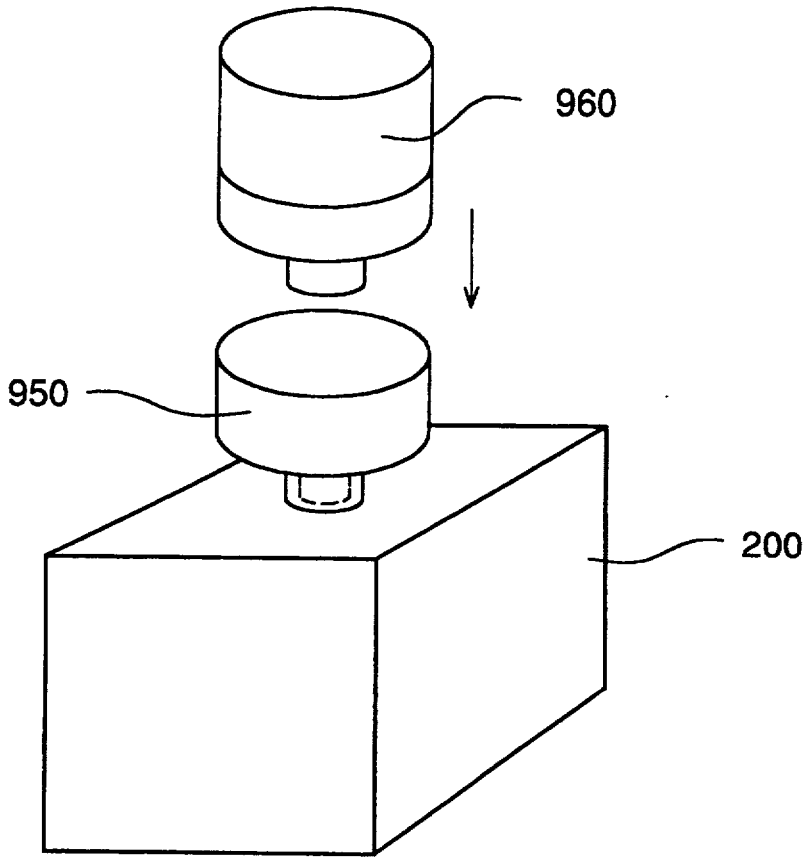
FIG. 15 is a sectional view showing a supporting plate for connection between a replenisher tank and a processing agent container.

Still another example of setting a replenisher tank for storage of the concentrated processing agents mentioned above to a receiving portion of a processing tank is shown in FIGS. 14 and 15. In the example, pouring pan 950 is attached to replenisher tank 200 and processing agent container 960 is set on the pouring pan 950. In this case, a shape of the pouring pan 950 is made to be the same as that of the processing agent container 960, but a color or a label may also be caused to be the same for setting.

Figure 16:
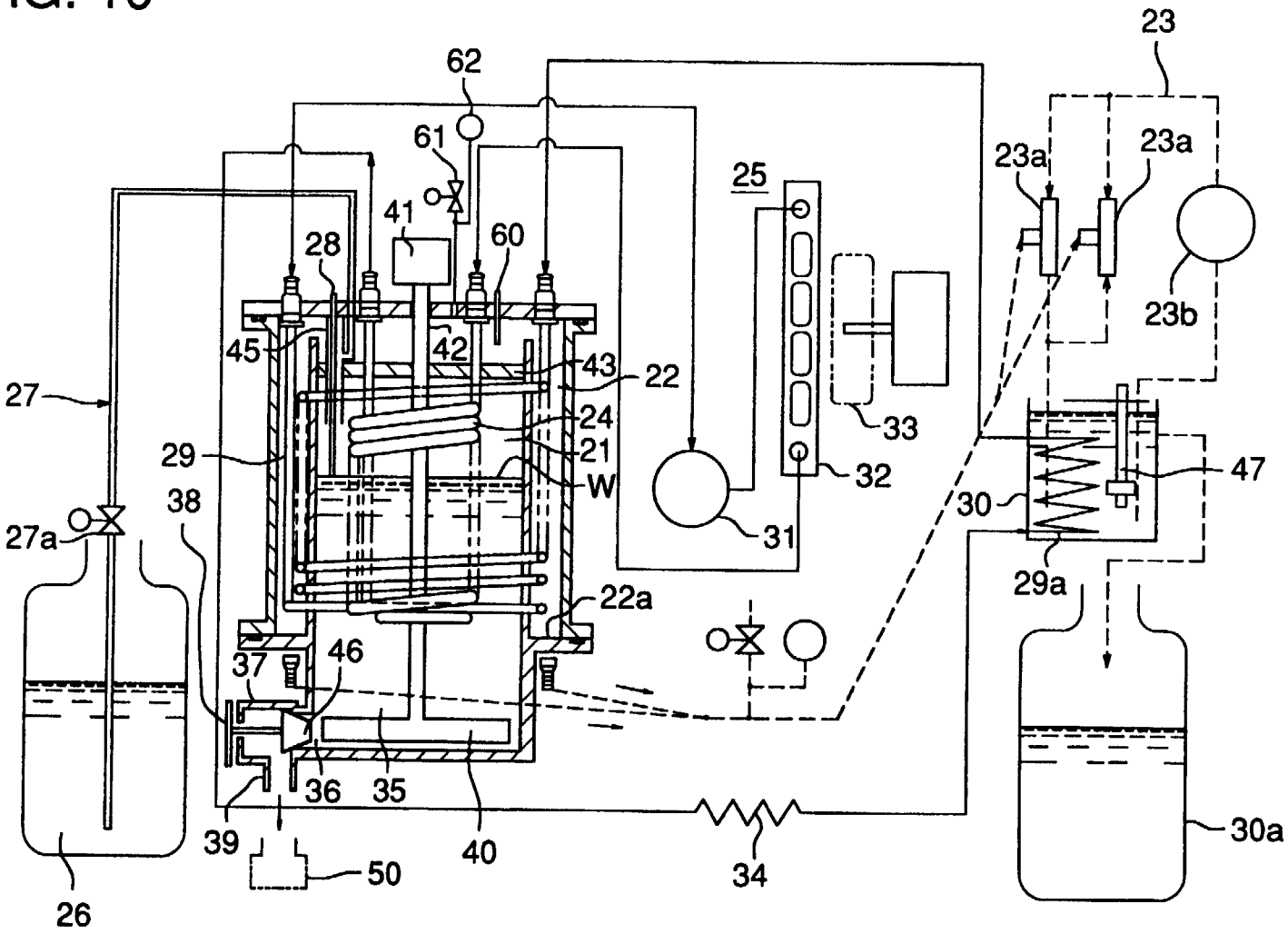
FIG. 16 is a schematic block diagram of an evaporator/distillator processor.

A role of an evaporator/distillator processor to be used in the invention is to distill waste liquids in photographic processing and it is shown in FIG. 16.

In FIG. 16, the numeral 21 represents an evaporating vessel capable of standing decompression and water solutions such as, for example, waste liquids in photographic processing are stored in the evaporating vessel 21. The numeral 22 is a cooling vessel provided concentrically outside the evaporating vessel, and an upper portion of the cooling vessel 22 is connected on a free communication basis and it is connected to pressure reducing means 23 to be decompressed. It is known that when the evaporating vessel 22 is kept at pressure lower than atmospheric pressure, boiling takes place at a temperature that is equal to or lower than the boiling point, and in the example, evaporation at a low temperature which hardly generates gas is carried out under the reduced pressure. As pressure reducing means 23, a vacuum pump method or an ejector method may be used, and among the ejector methods, the preferable one is a water-Jet pump method which is an ejector method by means of a stream of water, and it favorably accepted because it does not emit an offensive smell into air.

The numeral 24 is a heat-radiating portion provided spirally in the evaporating vessel 21, and compressor 31, heat-radiating portion 24, pressure reducing device 23, heat-absorbing portion 29 and refrigerant air-cooling means 32 are connected in succession to form heat pump unit 25 wherein heat media are sealed hermetically. The heat-radiating portion 24 of the heat pump unit 25 organizes a heating means whose surface temperature is controlled to be not more than 100° C., for the evaporation under reduced pressure, and is preferably controlled to be within a range from 30° C. to 40° C. for preventing generation of an offensive smell in particular. As the temperature-controlling method, a method wherein fan 33 is turned on or turned off by temperature of concentrated liquid in the evaporating vessel 21, or a method wherein fan 33 is turned on or turned off by temperature and pressure at heating side of cooling media (heat media) is preferable. The lower part of the heat-radiating portion 24 of the heat pump unit 25 is soaked in water solution W, while the upper portion thereof is protruded from the liquid level to be exposed to air. The heat-radiating portion 24 is arranged spirally to be partly in the air and to be partly in liquid for the purpose that the liquid and its surface are effectively heated simultaneously.

As heat media used in the heat pump unit 25, ammonia and Freon gas are generally used, and in the invention, Freon gas HCFC-22 is preferable on the point of efficiency of evaporation and concentration. For the compressor 31 of the heat pump unit 25, various methods including a rotor system are used and a compressor for an air-conditioning equipment such as a freezer, a refrigerator and an air-conditioner may also be used.

A double-can system wherein evaporating vessel 21 is provided inside and cooling vessel 22 is provided outside thereof is used. In this constitution, the total structure can be compact. In addition, demister 43 is provided on the liquid level in the evaporating vessel 21, and the upper portion of the demister 43 connects the evaporating vessel 21 to the cooling vessel 22 on a free communication basis. With such constitution, it is possible to prevent that concentrated components in the evaporating vessel 21 jump up and are mixed in condensed water in the cooling vessel 22, resulting in stable evaporation and concentration. The demister 43 is an aggregate of sintered bodies of sponge-shaped fibrous substances having a percentage of voids of not less than 80%, and its thickness is 1 cm or more. In practical use, Saran rock which is made by gluing Saran fibers with adhesives is favorably accepted.

For starting operation of the evaporator/distillator processor, a water-jet pump is started first for the stage of preparing decompression, and it is preferable to start supplying liquids in that stage. After a certain level of decompression, compressor 31 is started for operation to move to ordinary evaporation and concentration operation. As a method for detecting the level of decompression, either a method to use pressure sensor 62 or a method to move forcedly to the following step after a certain period of time may be used.

The numeral 26 is a tank wherein a water solution is stored, 27 is a water solution supplying means which is equipped with electromagnetic valve 27*a* and supplies a water solution into evaporating vessel 21. The water solution supplying means 27 is so arranged as to work when the liquid level in the evaporating vessel 21 is lowered through heating and evaporation to the level that is equal to or lower than the liquid level detected by liquid level detecting means 28. The water solution pumped up by the water solution supplying means 27 is supplied into the evaporating vessel 21 while washing an electrode of the liquid level detecting means 28 which detects a liquid level. Incidentally, a portion in liquid and a portion in the air both of the heat-radiating portion 24 are usually controlled to be the same in temperature, but in that case, the surface temperature of the portion in the air is substantially higher due to the difference in efficiency of heat transfer. Therefore, when waste liquids are supplied in the way of scattering directly over the heat-radiating portion 24, there is a possibility that offensive gases are generated due to rapid heating. For avoiding that trouble, it is necessary to control the amount of waste liquids to be supplied or to keep the temperature of the part in the air of the heat-radiating portion 24 to be equal to or lower than the temperature causing gases to be generated. Or it is possible to divide the heat-radiating portion 24 into two parts wherein one is in liquid and the other is in the air, and to control each of them to be at optimum temperature separately.

The liquid level detecting means 28 mentioned above is an electrode type liquid level detecting means which detects a liquid level with its electrode soaked in a water solution in the evaporating vessel 21. For the purpose of preventing malfunction of the liquid level detecting means 28 that is caused by concentrated sludge or the like, at least a part of the electrode is covered by cylinder 45 and water solution from tank 26 is first poured into the cylinder 45 and then is supplied to the evaporating vessel 21. For the same purpose, a part of the electrode of the liquid level detecting means 28 is covered by non-conductive substances, preferably by a high polymer heat contraction tube in which water-repelling material is more preferable, and most preferably by a Teflon heat contraction tube. It is also preferable that the cylinder 45 is made of non-conductive substance, such as, for example, plastics and material of the inner surface of the cylinder is silicone or Teflon.

Depending upon the results of detection made by the liquid level detecting means 28, water solution supplying means 27 can be controlled. When starting operation of evaporation and concentration, however, a fixed amount of water solution, namely, an amount that is free from any malfunction caused by the high liquid level in the evaporating vessel 21, for example, water solution in amount of 1/50–1/5 of the volume of the evaporating vessel 21 is supplied independently of the results of the liquid level detection. Owing to this, malfunction of starting operation with no liquid at the start caused by sludge sticking to the liquid level detecting means 28 can be prevented.

Further, when the liquid level detecting means 28 keeps detecting liquid for a certain period of time during operation, the liquid level detecting means 28 sometimes functions erroneously being caused by sticking sludge. For avoiding this trouble, forced supply of water solution in a certain amount is preferable, and the malfunction of the liquid level detecting means 28 can be prevented.

When gasified components in large quantity are contained in a water solution or components of surface active agents are contained therein, foaming of the water solution is caused during evaporation and foams are pushed up to the upper portion of the evaporating vessel 21, and they sometimes are mixed with condensed liquid in the cooling vessel 22. For avoiding this trouble, another electrode type liquid level detecting means 60 is provided at the upper portion of the vessel separately from the liquid level detecting means 28. When the state of foaming is detected by the liquid level detecting means 60, electromagnetic valve 61 is opened to discontinue the decompressed state in the evaporating vessel 21 so that concentrated liquid may not be mixed with condensed water. It is further preferable to have additionally a mechanism for pouring antifoaming agent of a silicone type or a fluorine type into the evaporating vessel 21.

Heat-absorbing portion 29 of the heat pump unit 25 mentioned above is a cooling means provided inside the cooling vessel 22, and it cools and condenses water vapor generated through evaporation of water solution in the evaporating vessel 21 and sent to the cooling vessel 22 through the space in the upper portion of the vessel. Condensed water thus prepared is gathered on the bottom portion 22*a* of the cooling vessel 22 and then is collected in condensed water tank 30 which is a container for collection installed outside of the vessel. This collection is made, in the present example, by pressure reducing device 23 employing ejector 23*a*. Namely, when water in condensed water tank 30 is pumped up by pump 23*b* and is sent back into the condensed water tank 30 through a vertical pipe of the ejector 23*a*, a vacuum space is generated at the place where a vertical pipe and a horizontal pipe meet at right angles. Therefore, liquid gathered on the bottom portion 22*a* of the cooling vessel that is connected to the horizontal pipe on a free communication basis and air in the cooling vessel 22 and air in the evaporating vessel 21 connected to the cooling vessel 22 on a free communication basis are sucked, contributing to stabilized decompression in both vessels 21 and 22. When pressure in the evaporating vessel 21 is increased by generated vapor, decompression balance is lost, but continuous concentration and collection of condensed water work effectively on the control of pressure rise through cooling and condensation. Water overflowed from the condensed water tank 30 is collected in storage container 30*a*. Incidentally, it is preferable that the ejector 23a is located below the bottom portion 22a.

Coolant cooling means 32 provided at the upstream side of the radiating portion 24 of the above-mentioned heat pump unit 25 cools the coolant pressurized by compressor 31 and thereby heated up to a high temperature down to an optimum set temperature, and is equipped with air cooling fan 33. At the downstream side of the heat-radiating portion 24 of the heat pump unit 25, there is provided capillary tube 34 which serves as an expansion valve, and a heat-absorbing portion located at the downstream side of the capillary tube 34 is utilized as heat-absorbing portion 29 in cooling means 29a and cooling vessel 22 for water in condensed water tank 30.

On the bottom of evaporating vessel 21, there is provided slurry sump 35 in which a slurry concentrated to high concentration after the repetition of evaporation and concentration is stored. Slurry outlet 36 is provided on the outer surface of a side wall at the level that is the same as the bottom of the slurry sump 35, and the slurry outlet 36 is stoppered hermetically with stopper means 37. The stopper means 37 may be of a type of a ball valve, a butterfly valve or a slide valve. In the case of one shown in the figure, however, it is of a type of packing stopper 46 because of a necessity to keep a pressure-reduced state in the evaporating vessel 21. The slurry outlet 36 can be opened or closed by pulling or pushing handle 38 connected to the packing stopper 46.

Further, the slurry sump 35 is provided with stirring blade 40 which is affixed on the lower end portion of output shaft 42 of driving source 41 mounted at the upper part of the evaporating vessel 21. The stirring blade 40 can stir over all area of the inner bottom surface of the slurry sump 35, and it is formed so that it may easily drive the slurry out toward the slurry outlet 36. The stirring blade may also be arranged naturally so that it is rotated manually by means of a handle. A part of the stirring blade 40 is arranged to pass through the portion near the slurry outlet 36 and the stirring blade 40 is rotated before the slurry is driven out so that concentrated liquids are agitated and all slurry sticking to the inner wall, especially to the heating portion at the upper part of the evaporating vessel 21 may be cleaned and raked out without being left inside the evaporating vessel 21.

A tip of slurry ejecting portion 39 that is opened at the lower part of stopper means 37 is arranged to be engaged with collected slurry container 50 which may also be a flexible container like a bag. The collected slurry container 50 is connected to the slurry ejecting portion 39 through a means of sealing hermetically such as a means of a screw-tightening type or a means of an elastic attaching/detaching type that is the same as a cap (not shown in the figure) to be attached on the container for collection. The reason for this is to enable an operator to take out slurry simply without contaminating hands.

For the purpose of removing, at an occasion of regular maintenance, the slurry that is converted to clogged scale during an ordinary concentration operation and stays inside the evaporating vessel 21, a scale-scraping-off blade (not shown in the figure) may be attached and used in place of the stirring blade 40 for removing slurry sticking to the middle portion of the evaporating vessel 21. The slurry-scraping-off blade may also be arranged so that it is rotated manually from the lower portion.

A transmission unit of a belt type is inserted into a part of a power-transmission mechanism between driving source 41 and the stirring blade 40 for the purpose of avoiding that the driving source 41 and the stirring blade 40 are forced to move when slurry becomes hard and thereby the stirring blade 40 does not move smoothly. Slurry has a property that it becomes fluid while it is being stirred, though it is hard in the beginning. Therefore, the stirring blade 40 rotates with a belt being slipped in the beginning, and then the stirring blade 40 can rotate smoothly.

Packing stopper 46 of the stopper means 37 is a rubber stopper, for example, and for the purpose of preventing that the rubber stopper is pushed in excessively, there is provided a stopper (not shown in the figure) so that the packing stopper 46 may not enter the slurry ejecting portion 39 exceeding a certain fixed distance. A preventing member for preventing that the rubber stopper 46 comes off in the reverse direction is further provided. Handle 38 also plays a role of preventing that slurry spouts out of the slurry ejecting portion 39 and scatters.

Liquid level detectors (for example, a float type one) are provided at least at a middle position and a position in the vicinity of a bottom surface of water solution tank 26 so that an operation may be controlled in a way that the operation is started when the water solution 26 is filled up to the middle position and the operation is stopped when the liquid level is lowered to the position that is close to the bottom surface. Further, condensed water tank 30 is provided with liquid level sensor 47 sot that an operation of an apparatus may be stopped when the condensed water tank 30 is filled up.

In the present example, water solution supplying means 27 is operated so that waste liquid, namely water solution may be poured into the evaporating vessel 21 until the level of the water solution arrives at a predetermined level that is detected by a liquid level detector, and tap water is poured into the condensed water tank 30 to be stored therein. After that, heating means 24 inside the evaporating vessel 21 is heated up to the predetermined temperature by the effect of coolant that is caused by compressor 31 to flow, and heat-absorbing portion 29 in cooling vessel 22 is cooled. On the other hand, contents in the cooling vessel 22 and evaporating vessel 21 are concentrated by the action of pump 23b through ejector 23a. Therefore, waste liquids are boiled and evaporated at the temperature equal to or lower than its boiling point.

Water vapor evaporated in the evaporating vessel 21 enters cooling vessel 22 through the upper space and it is cooled and condensed to be a water drop in the cooling vessel 22. Then, it is gathered at bottom portion 22a and then is collected through vacuum attraction into condensed water tank 30 installed outside the vessel. As water solution poured in the evaporating vessel 21 in advance is reduced due to evaporation, supplying means 27 operates to supply on a repeating basis in the evaporating vessel 21, thus water solution is gradually concentrated. Components solidified up to high concentration become slurry to be gathered at slurry sump 35 provided on the bottom portion.

Temperature of heat medium that is used in heat pump unit 25 is constantly detected, and thereby the degree of concentration is judged. When the temperature rises up to a certain level, concentration work is closed, handle 38 is pulled to draw packing stopper 46 of stopper means 37 to open slurry outlet 36 which has been hermetically sealed, thus slurry collected at the bottom of the evaporating vessel 21 is taken out to collected slurry container 50. When taking out the slurry, stirring blade 40 is rotated by driving source 41 for the better efficiency of the work for taking out slurry.

Since the evaporator/distillator processor works as described above for the concentration process for water solution, it can be used also for processing works of waste liquids and for concentration works for the stock solution.

ELECTRIC DIALYSIS DEVICE

Figure 17:
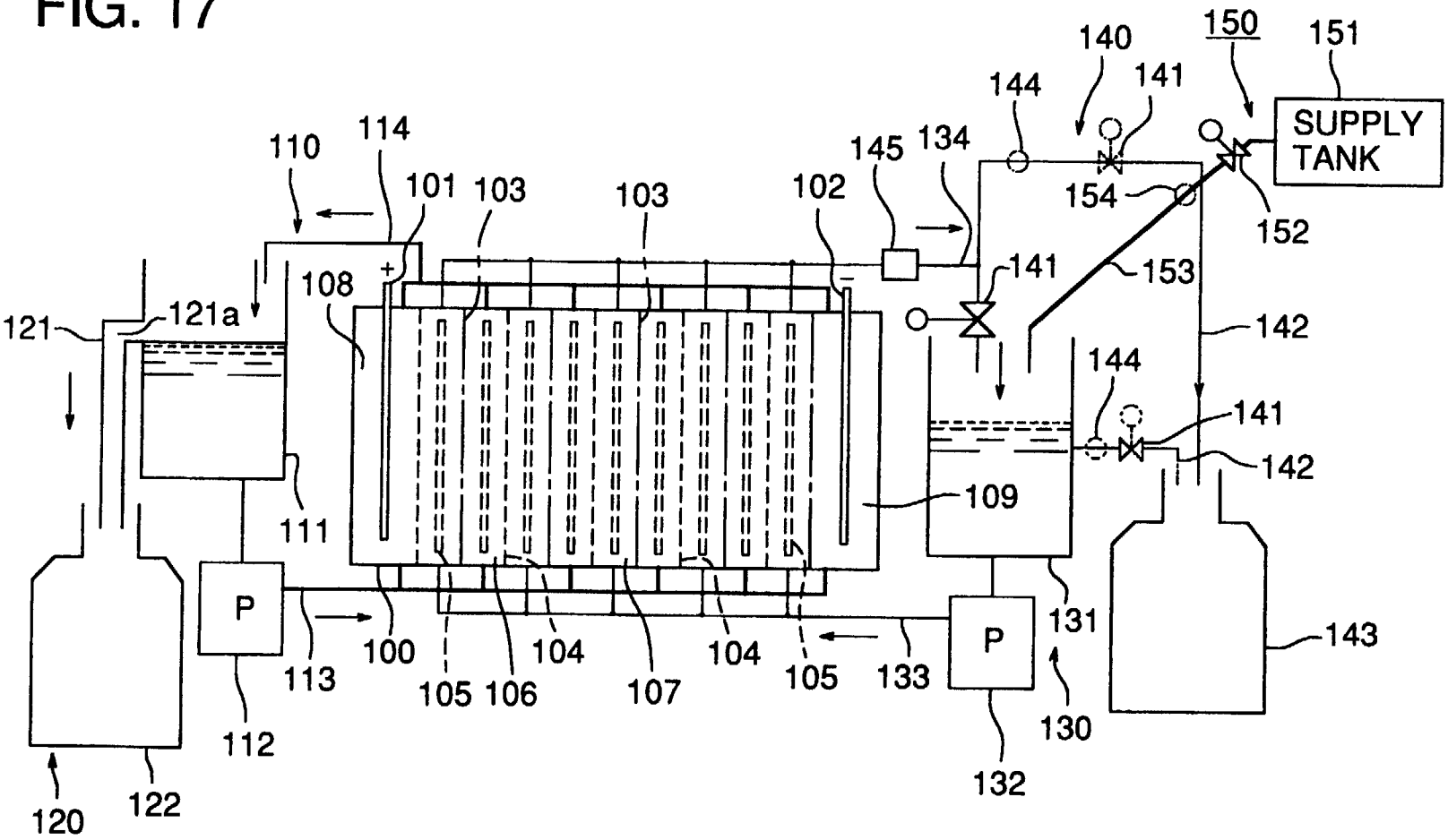
FIG. 17 is a schematic block diagram of an electric dialysis device.

Next, an example of an electric dialysis device used for the invention will be explained as follows, referring to FIG. 17. In the electric dialysis device to be used in the invention, electric dialysis tank 100 is provided with positive electrode 101 and negative electrode 102. Between the positive electrode 101 and the negative electrode 102, there are provided cation exchange membranes 103 and anion exchange membranes 104 which are arranged through chamber frames 105 alternatively to form concentrating chambers 106 and desalting chambers 107 alternatively.

Current density in electric dialysis conducted by the electric dialysis device is preferably 0.1–10 A/dm$^2$ and is more preferably 1–8 A/dm$^2$. Current concentration is preferably 0.1–5 A/l or less, and more preferably 0.5–4 A/l or less. When the current density exceeds 10 A/dm$^2$, ammonia, sulfurous acid or the like show poor separation. When the current concentration exceeds 5 A/l, ammonia, sulfurous acid, or the like show poor separation, again. The values less than 0.1–1A/l and 1 A/dm$^2$ are not preferable because a large-sized apparatus is needed. Voltage that offers the aforementioned current density or current concentration is acceptable.

The cation exchange membranes used for the electric dialysis device mentioned above are manufactured by manufacturers such as Ionics Co., Toyo Soda Co., Du Pont Co. Asahi Glass Co. and are available on the market. The anion exchange membranes are also manufactured by Ionics Co. and others and are available on the market.

It is preferable that an electric dialysis tank is made of an electrically insulating material which withstands use for a long period of time or repeated use, and polyepichlorohydrin, polyvinylmethacrylate, polyethylene, polypropylene, polyvinyl chloride, polyethylene chloride, phenol-formaldehyde resin and others which are synthetic resins may be used preferably in particular. The aforementioned feeding anodes which offer positive D.C. voltage are made of materials such as, for example, carbon materials (for example, activated carbon, charcoal, cokes and lime), graphite materials (for example, carbon fiber, carbon cloth), carbon-compounded materials (for example, a material wherein metal powder is mixed with carbon to be sintered), unwoven fabric of activated carbon fiber (for example, KE-100 felt made by Toyo-Bo Co.), or the materials wherein platinum, palladium or nickel is held in the unwoven fabric of activated carbon fiber, further dimension-stabilized electrodes (platinum oxide-coated titanium material, iridium oxide-coated titanium such as, for example, DSA expand mesh), platinum-coated titanium materials, nickel materials, stainless steel materials, and steel materials. Feeding cathodes which face the feeding anode and offer negative D.C. voltage are made of materials such as, for example, platinum, stainless steel, titanium, nickel, Hastelloy, graphite, carbon materials, mild steel, or metal material coated with platinum metal. It is preferable that electrodes which are in a mesh form or in a tabular form are used as the electrode mentioned above.

The electric dialysis device is equipped with means 110 for circulating concentrated liquids to concentrating chamber 106 and with means 120 for collecting concentrated liquids in quantity corresponding to an amount that increases during operation of the electric dialysis device.

The means 110 that circulates concentrated liquids to concentrating chamber 106 is equipped with concentrated liquid tank 111, circulating pump 112 and circulating pipes 113 and 114 so that concentrated liquids stored in the concentrated liquid tank 111 may be fed by circulating pump 112 to the concentrating chamber 106 of electric dialysis tank 100 through circulating pipes 113 and 114.

The means 120 for collecting concentrated liquids in quantity corresponding to an amount that increases during operation of the electric dialysis device is equipped with overflow pipe 121 and collecting container 122. When the electric dialysis device is operated, concentrated liquids are increased through desalting, and the concentrated liquids in an amount of the increase overflow the concentrated liquid tank 111 through overflow outlet **121*a* of the overflow pipe 121, and then are collected automatically in the collecting container 122. The collecting means for increased concentrated liquids wherein concentrated liquid tank 111 that holds concentrated liquids outside the electric dialysis device is provided as described above, the concentrated liquids are circulated by a circulating means between the concentrated liquid tank 111 and the electric dialysis device and overflow outlet 121*a* is provided on the concentrated liquid tank 111** for collecting the increased concentrated liquids through overflowing, is practical and preferable, causing an apparatus to be simplified.

Figure 18:
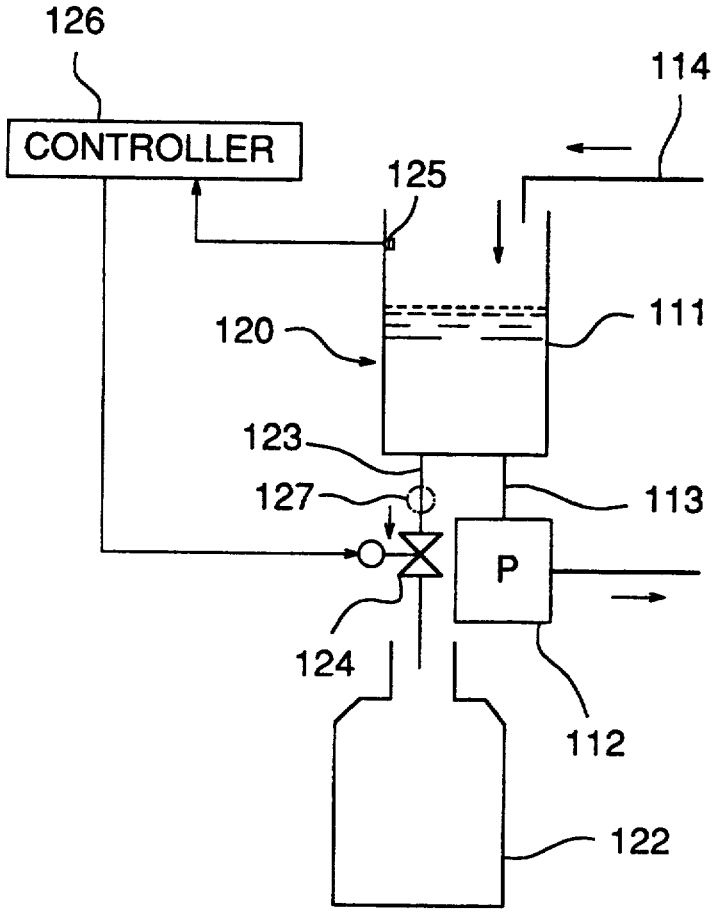
FIG. 18 is a schematic block diagram of a means for controlling an increase of concentrated liquid in an electric dialysis device.

It is also possible to provide ejection pipe 123 at a predetermined position on the concentrated liquid tank 111 and to provide electromagnetic valve 124 on the ejection pipe 123 as shown in FIG. 18, and to collect increased concentrated liquids from the ejection pipe 123 to collecting container 122 by activating the electromagnetic valve 124 with control device 126 when liquid level sensor 125 provided on the concentrated liquid tank 111 detects an increase of the concentrated liquids. It is further possible to collect increased concentrated liquids by electromagnetic valve 124 which is activated after the passage of a predetermined period of time, or it is possible to collect increased concentrated liquids forcedly by employing pump 127 in place of the electromagnetic valve 124, or to collect manually by means of a manual operation valve.

As described above, there occurs a phenomenon that when concentration of desalted liquid which is a water solution to be supplied to desalting chamber 107 of the electric dialysis device is higher than that of the concentrated liquid, an amount of water moving together with salts in desalting is large, while when the concentration is lower, the amount of moving water is small. However, it is possible to concentrate the concentrated liquids up to the limit value of concentration in electric dialysis regardless of the concentration of water solution for collection in a collecting way wherein concentrating chambers 106 and desalting chambers 107 are formed alternately, concentrated liquids are circulated to the concentrating chambers 106 and the electric dialysis device is operated for the collection of increased concentrated liquids.

Means 130 for circulating water solution to the desalting chamber 107 of the electric dialysis device, means 140 for taking out water solution at the point where the water solution has been desalted to a certain level of concentration and means 150 for supplying water solution for further desalting are provided.

The means 130 for circulating water solution to the desalting chamber 107 is equipped with desalted liquid tank 131, circulating pump 132 and circulating pipes 133 and 134, and desalted liquids stored in the desalted liquid tank 131 are fed by the circulating pump 132 to the desalting chamber 107 of the electric dialysis tank 100 through circulating pipes 133 and 134, for circulation.

The means 140 for taking out water solution when the water solution has been desalted to a certain level of concentration is equipped with electromagnetic valve 141 provided on the circulating pipe 134, ejection pipe 142 connected to the electromagnetic valve 141 and collecting container 143, and when the electromagnetic valve 141 is closed after the lapse of a certain period of time, water solution is ejected from the circulating pipe 134 through the ejection pipe 142 and collected into the collecting container 143.

As a method for estimating that water solution has been desalted to a certain level of concentration, stipulation of time period by means of experimental values is inexpensive and preferable, but another method wherein a conductivity measuring instrument is provided on 145 to detect the value which is other than a certain fixed value is a most sure method. It is also extremely preferable to measure current of the electric dialysis tank and detect that the value is out of a certain fixed value, or to change this point of time to the one after a certain period of time.

Further, the electromagnetic valve 141 may also be provided on the ejection pipe 142 which is further provided at the predetermined position on the desalted liquid tank 131 so that water solution may be collected into collecting container 143 by means of operation of the electromagnetic valve 141 provided on ejection pipe 142. It is further possible to provide pump 144 in place of the electromagnetic valve 141 for forced collection, or manual collection by means of a valve of a manual operation type is also applicable.

The means 150 for supplying water solution for further desalting is equipped with supply tank 151, electromagnetic valve 152 and supply pipe 153, and the supply tank 151 stores water solution to be further desalted, such as, for example, distilled liquids obtained in the evaporator/distillator processor mentioned above. The water solution is fed from the supply tank 151 to the desalted liquid tank 131 by means of an action of the electromagnetic valve 152 through the supply pipe 153. When the supply pipe 153 is equipped with pump 154 in place of the electromagnetic valve 152, water solution can be fed forcedly regardless of where the supply tank 151 is installed. Manual collection of water solution by means of a valve of a manual operation type is also applicable. Further, it is possible to feed distilled liquids from the above-mentioned evaporator/distillator processor directly to the desalted liquid tank 131 through a pipe without using the supply tank 151.

When water solution is circulated to the desalting chamber 107 of the electric dialysis device, the desalted water solution is taken out at the point of desalting to a certain level of concentration and another water solution is supplied for further desalting as described above, efficient desalting can be conducted on a batch and circulation basis, and if the aforementioned collection of increased concentrated liquids is conducted simultaneously, the final desalted concentration is low and it is preferable.

Figure 19:
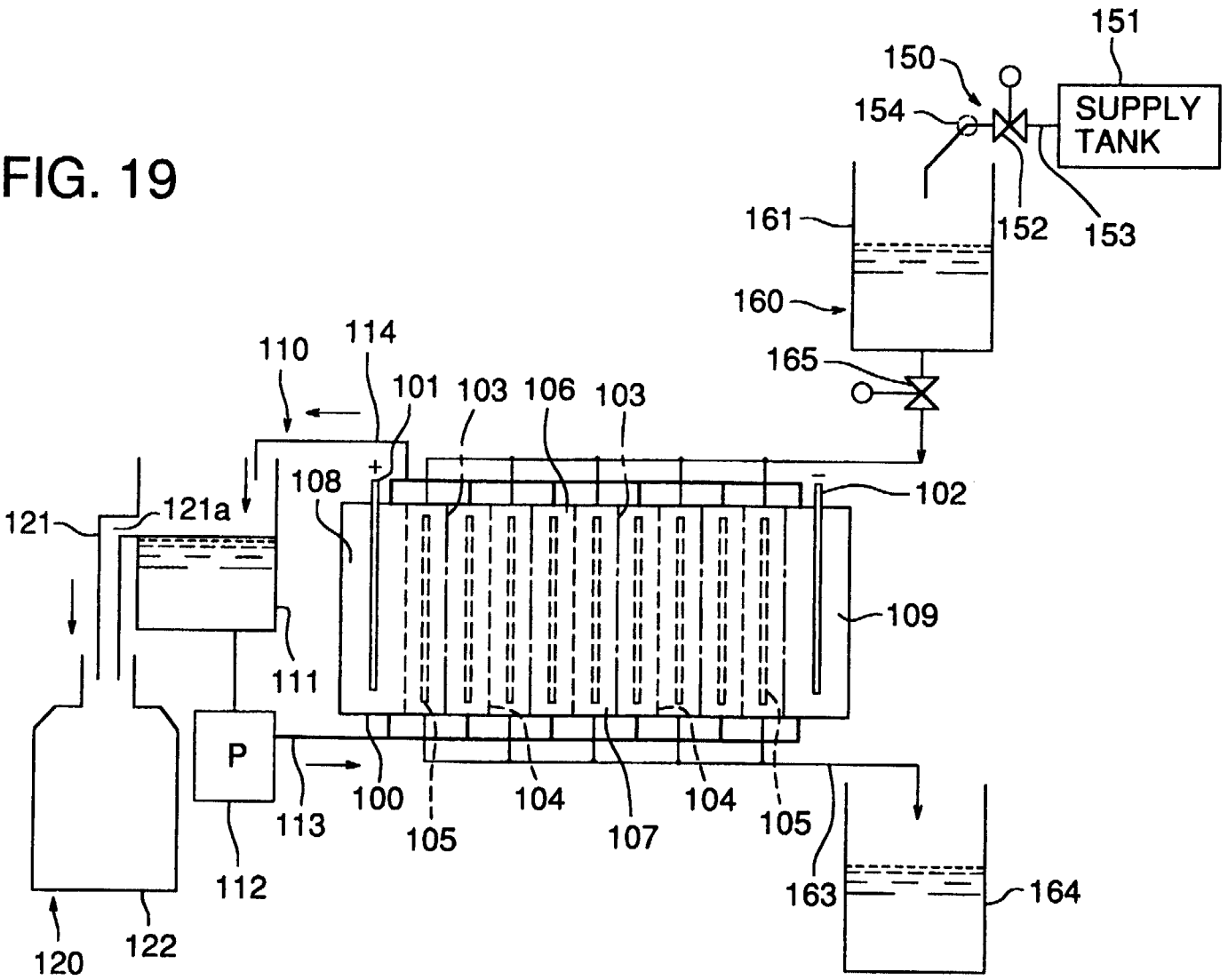
FIG. 19 is a schematic block diagram of other example of the electric dialysis device.

FIG. 19 shows another example of the electric dialysis device which is equipped with means 160 that supplies water solution to the electric dialysis device for transitory processing. The means 160 that supplies water solution to the electric dialysis device for the transitory processing is equipped with desalted liquid supply tank 161, desalted liquid supply pipe 162, desalted liquid ejection pipe 163 and desalted liquid ejection tank 164, and the desalted liquid supply pipe 162 feeds water solution to desalting chamber 107 through electromagnetic valve 165 and the water solution is collected from the desalting chamber 107 to the desalted liquid ejection tank 164 through the desalted liquid ejection pipe 163. In this way, water solution is supplied to the electric dialysis device for transitory processing, and thereby concentration of concentrated liquid is stabilized.

Desalted liquids obtained from the processing of waste liquids from photographic processing are supplied to processing tanks of an automatic processor to be used again as described above. Therefore, substantial quantity of processing agent for replenishing can be reduced remarkably.

It is also possible to control concentration itself of gas component entering condensed liquid from an evaporator/distillator processor which is equipped with a heat pump, and thereby substantial quantity of processing agent for replenishing can be reduced remarkably without being influenced by various photographic processing solutions and components of processing solution caused by variation of processed volume.

In addition, concentrated processing agents to be supplied to at least one processing step in an automatic processor are supplied after being divided into two or more kinds, which contributes to improvement in stability of processing agents and to enhancement of stability of the system.

Further, concentrated processing agents are supplied in a way that quantity of the concentrated processing agents to be supplied is equal to 1/3–1/50 of desalted liquids to be supplied. Therefore, processing capability is stabilized.

It is further possible to cope with evaporation-grounded variation with the passage of time, because a liquid level detecting means is provided on a processing tank and desalted liquids are supplied based on the signals from the liquid level detecting means.

Furthermore, waste liquids in photographing processing ejected from two or more automatic processors are subjected to evaporation and concentration processing in a system composed of two or more automatic processors. Therefore, it is advantageous in terms of a floor space required and cost, and it provides stabilized desalting.

Waste liquids in photographic processing ejected from both an automatic processor for processing color negative films and an automatic processor for processing color photographic papers are processed collectively, and desalted liquids obtained from the aforementioned processing are supplied to the automatic processor for color negative films and the automatic processor for color papers mentioned above. Therefore, it is possible to organize a united system which is extremely excellent in maintenance, requires less man-hour, and is stable.

Concentrated processing agents are used to be replenished to processing tanks, and the quantity of each concentrated processing agent is established so that respective supply of all concentrated processing agents to the plurality of processing tanks mentioned above may be finished almost simultaneously. Therefore, concentrated processing agents can be replaced at the same time, resulting in easy and simple handling.

It is further possible to maintain capability of processing solutions, and to stabilize the processing against the passage of time because electric dialysis concentrated liquid is supplied to processing steps in an automatic processor and the electric dialysis concentrated liquid contains components for preserving processing solutions.

Desalted liquids to be supplied to a step of washing or a step of waterless stabilizing both following a step of fixing among processing steps in the automatic processor are supplied separately from the replenishment for processing of light-sensitive materials when an amount of photographic light-sensitive materials to be processed in a certain period of time is small, resulting in stabilized processing which is free from problems of exposure unevenness and those in finishing of white background on a light-sensitive material.

A desalted liquid storage tank is equipped with a sterilizing means, and owing to the sterilizing means, damage to desalted liquid caused by microbes can be prevented.

Waste liquids in photographic processing discharged from these processing tanks are stored in a waste liquid storage tank 600, and the waste liquids are supplied from the waste liquid storage tank to an evaporator/distillator processor. Thus the waste liquid storage tank serves as a buffer and backs up a system having a small processing capacity.

Owing to an arrangement wherein a color and/or a shape of a replenisher tank for storing concentrated processing agents are the same as those of a receiving stand on a processing tank, erroneous operation can be prevented in a simple structure.

Figure 20:
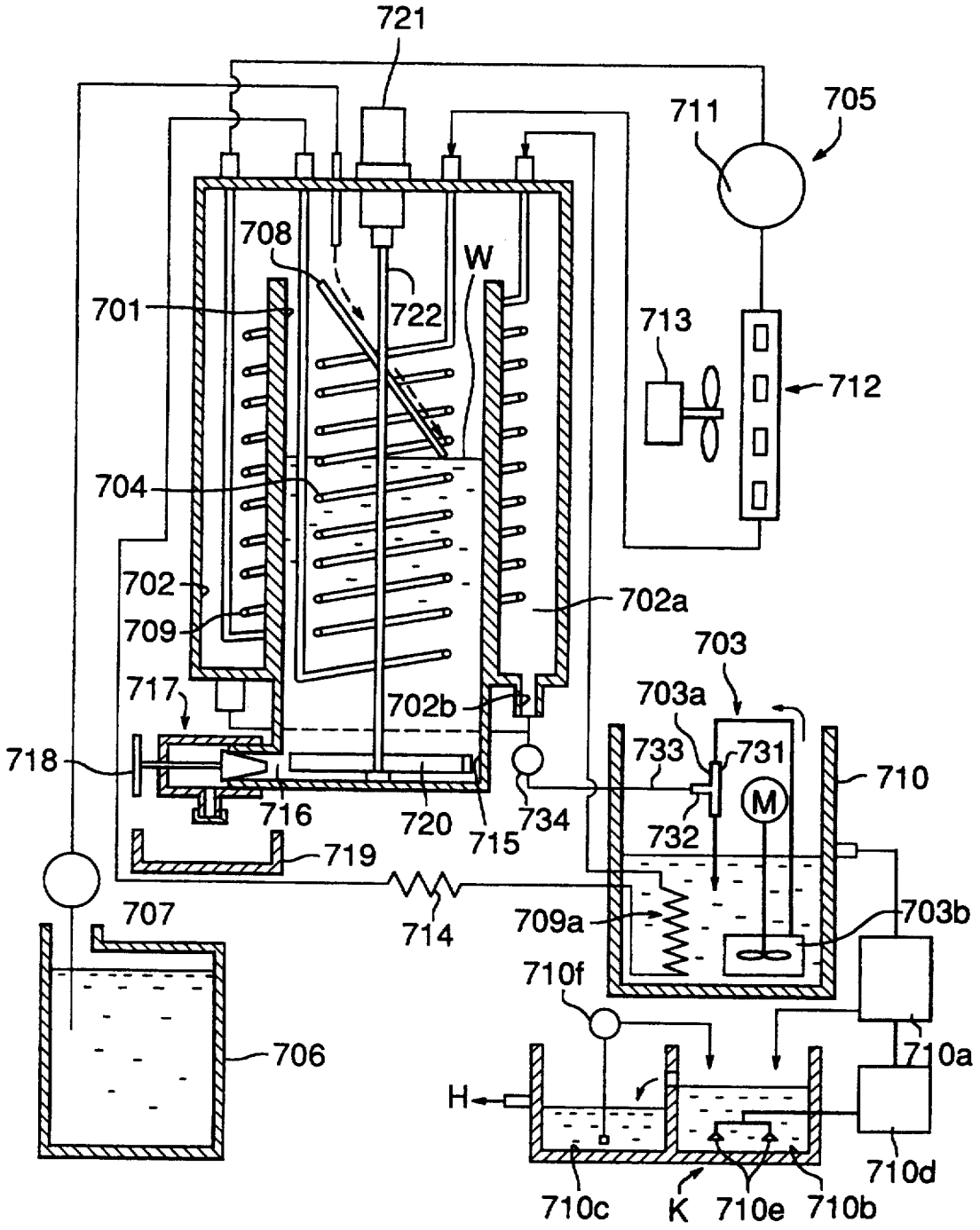
FIG. 20 is a schematic diagram of an evaporator/distillator processor.

The invention will be explained as follows, referring to another example shown in FIG. 20.

In the figure, the numeral 701 is an evaporating vessel which can withstand decompression and a water solution (to be concrete, waste liquid in photographic processing) is poured into the evaporating vessel 701 to be stored therein. The numeral 702 represents a cooling vessel provided outside the evaporating vessel 701 concentrically, and an upper portion of the cooling vessel 702 is connected to the evaporating vessel 701 on a free communication basis. The numeral 703 is a pressure reducing means composed of a vacuum pump which makes the pressure in the inner part of the cooling vessel 702 lower than atmospheric pressure. Due to this, water solution boils at a temperature that is not more than its boiling point. In this example, evaporation takes place at a low temperature so that offensive gas is hardly generated.

The numeral 704 is a heating means provided in the aforementioned evaporating vessel on a three-dimensional basis, and a heat-radiating portion of heat pump circuit 705 serves as the heating means 704. A temperature on the surface of the heating means 704 is not more than 100° C. under decompression evaporation, and it is most preferable to control the temperature within a range of 20° C. -60° C., especially for preventing occurrence of offensive gas. The lower part of the heating means 704 is soaked in waste liquids in photographic processing, while the upper portion thereof is protruded from the liquid level to be exposed to air. The heating means 704 is arranged on a three-dimensional basis to be partly in the air and to be partly in liquid for the purpose that the liquid and its surface are effectively heated simultaneously.

The numeral 706 is a storage tank (container) wherein waste liquids in photographic processing W collected from photofinishing laboratories of color processing are stored, 707 is a pumping up means equipped with an electromagnetic valve which pumps up the waste liquids in the storage tank 706 and feeds them to evaporating vessel 701. The pumping-up means 707 is so arranged as to operate when a liquid level in the evaporating vessel 701 falls along a certain length. Waste liquids pumped up by the pumping up means 707 are either scattered directly over the heating means in the air inside the evaporating vessel 701 or supplied along suitable guide plate 708 causing no ripple as shown in the figure. Incidentally, a portion in liquid and a portion in the air both of the heating means 704 are usually controlled to be the same in temperature, but in that case, the surface temperature of the portion in the air is substantially higher due to the difference in efficiency of heat transfer. Therefore, when waste liquids are scattered directly over the portion of the heating means 704 in the air, there is a possibility that offensive gases are generated due to rapid heating. To avoid that trouble, it is necessary to control the amount of waste liquids to be supplied or to keep the temperature of the part in the air of the heating means 704 to be equal to or lower than the temperature causing gases to be generated. Or it is possible to divide the heating means into two parts wherein one is in liquid and the other is in the air, and to control each of them to be at optimum temperature separately.

The numeral 79 is a cooling means installed in the aforementioned cooling vessel 702, and a compressor, a heat-radiating portion, a pressure reducing device and a heat-absorbing portion are connected successively to be the cooling means 709, and a heat-absorbing portion of heat pump circuit 705 wherein heat media are hermetically sealed is used. Water vapor evaporated in the evaporating vessel 701 enters the cooling vessel 702 through the upper space is caught by the cooling means 709 to be cooled and condensed. The condensed water is ejected from condensed water outlet **702*b* provided on the bottom portion 702*a* of the cooling vessel 702, and then is collected into tank 710** installed outside the vessel.

The aforementioned ejection is conducted by means of pressure reducing means 703 employing ejector **703*a*. With regard to a principle for that, when condensed water in the tank 710 is pumped up in the arrowed direction by liquid-feeding pump 703*b* having blades connected directly to motor M that is installed outside the tank and fed back into the tank 710 through vertical pipe portion 731 of the ejector 703*a*, horizontal pipe portion 732 which cuts the vertical pipe portion 731 at right angles forms a vacuum. Therefore, when a port (vacuum suction port) of the horizontal pipe portion 732 is connected to condensed water outlet 702*b* of the aforementioned bottom portion 702***a* of the cooling vessel through tube 733, condensed water gathered on the bottom portion 702*a* of the cooling vessel 702 and air in the cooling vessel 702 and in the evaporating vessel 701 connected to the cooling vessel 702 on a free communication basis are forcedly sucked, contributing to stabilized pressure reduction in both vessels.

In the tank 710 mentioned above, there is soaked cooling means 709*a* which is a part of a heat-absorbing portion of the heat pump circuit 705 that can cool for deodorization the condensed water collected in the tank 710. The numeral 734 is a back-flow-check means and it is provided on the half way of the tube 733 mentioned above so that the back-flow-check means may check effectively the back flow of the condensed water collected in the tank 710 from the bottom portion 702*a* of the cooling vessel 702 through ejector 703*a* even when the tank 710 is in a higher position.

An activated sludge processing means is represented by K and it is composed of adjusting tank 710*a* into which condensed water that overflowed the tank 710 is collected, aeration tank 710*b* and precipitation tank 710*c*. When a level of the condensed water collected in the adjusting tank 710*a* arrives at a certain water level, the condensed water is fed by an unillustrated pump to the aeration tank 710*b*. When the condensed water flows into the aeration tank 710*b*, blower 710*d* operates to take air in the tank through supply opening 710*e*, thus sufficient oxygen is supplied to activated sludge, resulting in promotion of breeding of aerobic microbes and activation of their action. Though only one aeration tank 710*b* is shown in the figure for convenience' sake, two or more aeration tanks may be installed successively in a way that each aeration tank is equipped with blower 710*d* and supply opening 710*e*.

The aeration tank 710*b* mentioned above may be either of a type wherein activated sludge floats in the aeration tank or of a type wherein a filtering member to which microbes stick is provided. Since condensed water extracted from waste liquids in photographic processing contains ammonia, acetic acids and alcohol, it may be possible either to use microbes for treatment and disposal of raw sewage as initial sludge or to drain the condensed water into activated sludge processing facilities for raw sewage to be processed in common with the raw sewage.

The condensed water aerated sufficiently in the aeration tank 710*b* is fed from the upper portion of the aeration tank to the precipitation tank 710*c* where the condensed water is precipitated and separated, and supernatant liquids therefrom are discharged H through after-treatment process that is conducted in case of need. Sludge precipitated in the precipitation tank 710*c*, on the other hand, is fed back to the aeration tank 710*b* through returning device 710*f* because the sludge contains aerobic microbes in large quantities. It is preferable that this feeding back of the precipitated sludge is conducted in the case of the aeration tank 710*b* wherein sludge floats as a matter of course, and even in the case of contact aeration.

Increase and decrease in flux of condensed water that flows into the aeration tank 710*b* from the adjusting tank 710*a* mentioned above are detected by an unillustrated detecting means, and thereby the operation or suspension of the blower and output of the blower are determined.

The numeral 711 represents a compressor for compressing coolant for the heat pump circuit 705, and the numeral 712 is a coolant-air-cooling means provided on the upstream side of heating means 704 of the evaporating vessel 701 mentioned above. A function of the coolant-air-cooling means 712 is to lower the temperature of the coolant heated up to a high temperature through pressurization and compression by the compressor 711 mentioned above to an optimum set temperature, and it is equipped with air-cooling fan 713. The numeral 714 is a capillary tube (inflater), and a heat-absorbing portion located at the downstream side of the capillary tube 714 is utilized as cooling means 709*a* for water in the tank 710 and as cooling means 709 located inside the cooling vessel 702. Namely, the upstream side of the capillary tube 714 is a heating zone, while the downstream side thereof is a cooling zone. Coolant which has passed through the cooling means 709 located inside the cooling vessel 702 is fed back to the compressor 711.

The numeral 715 is a slurry sump wherein components (slurry) solidified to high concentration after repetition of evaporation and concentration is collected, and the slurry sump 715 is provided on the bottom portion of the evaporating vessel 701. The numeral 716 is a slurry outlet provided protrusively on the outer surface of a side wall at the same level as the bottom of the slurry sump 715, and the slurry outlet 716 is stoppered hermetically with stopper means 717. The stopper means 717 may be of a type of a ball valve, a butterfly valve or a slide valve. In the case of one shown in the figure, however, it is of a type of packing material because of a necessity to keep a pressure-reduced state in the evaporating vessel 701. The slurry outlet 716 can be opened or closed by pulling or pushing handle 718. The numeral 719 is a slurry collecting container.

The numeral 720 is a rotating blade provided on the slurry sump 715, and the rotating blade 720 is affixed on the lower end portion of output shaft 722 hanging down from driving source 721 mounted at the upper part of the evaporating vessel 701. The rotating blade 720 can stir over the inner bottom surface entirely, and it is formed so that it may easily drive the slurry out toward the slurry outlet 716. The rotating blade may also be arranged naturally so that it is rotated manually by means of a handle.

In the example mentioned above, the pumping-up means 707 is operated to pour waste liquid W up to the necessary level in the evaporating vessel 701. After that, pressure reducing means (vacuum pump) 703 is operated. The pump 703 reduces pressure in the cooling vessel 702 and evaporating vessel 701. After that, compressor 711 of the heat pump circuit 705 and cooling fan 713 of the coolant-air-cooling means 712 are operated. Thus, concentration operation is started. Then, heating means 704 in the evaporating vessel 701 is heated up to the predetermined temperature, cooling means 709 in the cooling vessel 702 is cooled, and waste liquids boil and evaporate at the temperature lower than their boiling point under atmospheric pressure, such as, for example, 35° C.

Water vapor evaporated in the evaporating vessel 701 enters cooling vessel 702 through the upper space to be cooled and condensed in the cooling vessel to form water drops which are collected on the bottom portion 702*a* of the cooling vessel 702. This condensed water is forcedly sucked by a vacuum suction port of ejector 703*a* from condensed water outlet 702*b* of the bottom portion 702*a* through tube 733 to be collected in tank 710. Together with the condensed water, air (gases) in the cooling vessel 702 and in the evaporating vessel 701 connected to the cooling vessel 702 on a free communication basis are also sucked, and these gases are discharged into the air after they contact the condensed water in the tank 710, thus an offensive smell contained in the gases can be removed.

As described above, when waste liquids poured into vessel 1 in advance through evaporation is reduced, pumping-up means 707 operates accordingly to supply fresh liquid, and the waste liquids are concentrated gradually through repetition of the aforementioned evaporation and supply. Components solidified to high concentration are collected as slurry on slurry sump 715 that is provided on the bottom portion.

Although no illustration is given in the figure, it is preferable that a spatter-preventing means (demister spatter-preventing plate or the like) is provided primarily on the top of the evaporating vessel so that no concentrated liquids may spatter on the upper connection portion between the evaporating vessel 701 and the cooling vessel 702 and enter the cooling vessel.

After the concentration processing for waste liquids has been finished as in the foregoing, slurry outlet 716 stoppered hermetically is opened so that slurry gathered on the bottom portion of the evaporating vessel 701 may be taken out to slurry collecting container 719. For taking out the slurry, rotating blade 720 is rotated by driving source 722 to secure better efficiency of operation for taking out slurry.

When a level of the condensed water overflowing the tank 710 and collected in the adjusting tank **710*a* arrives at a certain water level, the condensed water is fed by an unillustrated pump to the aeration tank 710*b*. In the aeration tank 710*b*, oxygen in air supplied from blower 710*d*** is given sufficiently to activated sludge, resulting in promotion of breeding of aerobic microbes and activation of their action. When microbes for treatment and disposal for raw sewage are used as initial sludge, it is preferable for processing waste liquids in photographic processing containing ammonia, acetic acids and alcohol.

The condensed water aerated sufficiently in the aeration tank **710*b* is fed from the upper portion of the aeration tank to the precipitation tank 710*c*** where the condensed water is precipitated and separated (solidified components containing harmful substances such as ammonia, acetic acids and alcohol precipitate) and supernatant liquids therefrom which are clean water are discharged H. This water causes no problems of environmental pollution even when it is drained into rivers.

Although a cooling portion for condensed water is provided between condensed water outlet **702*b* of the cooling vessel 702 mentioned above and activated sludge processing means K in the example mentioned above, it is naturally possible to connect the condensed water outlet 702*b* of the cooling vessel 702 directly to the activated sludge processing means K. Even when the condensed water overflowing the tank 710** is drained into activated sludge processing facilities for raw sewage to be processed in common with the raw sewage, the condensed water can be processed effectively.

As stated above, the invention makes it possible to drain the condensed water taken out of the vessel in rivers or the like as harmless effluent without taking any action, because a condensed water outlet of a cooling vessel is connected to an activated sludge processing means, which is an excellent effect.

Further, the invention can process condensed water taken out of a vessel effectively to convert into harmless one, which is also an excellent effect.

What is claimed is:

1. An automatic processing apparatus for processing photographic light-sensitive material, comprising:

(a) an automatic processor having (1) a processing tank containing a processing solution with which the photographic light-sensitive material is processed, and (2) means for replenishing a concentrated processing replenisher chemical solution to said processing tank, a deteriorated processing solution being restored by the concentrated processing replenisher chemical solution so that continuous photographic processing can be maintained;

(b) an evaporator/distillator processor by which waste liquid in photographic processing discharged from said automatic processor is evaporated and concentrated by heating, and vapor generated by the heating is condensed by cooling so that a condensate is produced, wherein said evaporator/distillator processor comprises:

(1) a compressor;

(2) an evaporating vessel having a heating means;

(3) a cooling vessel having a cooling means;

(4) a pressure reducing device for reducing the entire pressure in both said evaporating vessel and said cooling vessel, said vessels being in communication; and (5) a heat pump device in which heat transfer media is hermetically sealed and circulated through said compressor, said heating means, said pressure reducing device and said cooling means, wherein said heating means and cooling means are used for evaporating and concentrating the waste liquid, and for cooling and liquefying the vapor;

(c) an electric dialysis device for separating the condensate into an electric dialysis concentrated liquid and a desalted liquid, wherein cation exchange membranes and anion exchange membranes are arranged alternately between a positive electrode and a negative electrode, and alternate concentrating chambers and desalting chambers are formed by both said ion exchange membranes and chamber frames; and (d) a desalted liquid storage tank for storing the desalted liquid, from which the desalted liquid is supplied to said processing tank.

2. The apparatus of claim 1, wherein the concentrated processing replenisher chemical solution to be supplied is after being divided into two kinds or more.

3. The apparatus of claim 1, wherein the electric dialysis concentrated liquid is supplied to processing step in said automatic processor.

4. An evaporator/distillator processor for an aqueous solution, comprising:

(a) a compressor;

(b) an evaporating vessel having a heating means for evaporating and concentrating an aqueous solution;

(c) a cooling vessel having cooling means for condensing vapor generated by said heating means, and having a condensate outlet for discharging a condensate;

(d) a pressure reducing device for reducing the entire pressure in both said evaporating vessel and said cooling vessel, said vessels being in communication;

(e) a heat pump device in which heat transfer media is hermetically sealed, and circulated through said compressor, said heating means, said pressure reducing device and said cooling means; and (f) an activated-sludge processing means connected to said outlet, for biologically processing the condensate.

5. The processor of claim 4 further comprises a condensate cooling unit between said outlet and said activated-sludge processing means.

6. The processor of claim 14, wherein the aqueous solution to be concentrated is a waste liquid in photographic processing.

7. A method of processing a waste liquid in photographic processing, comprising the steps of:

(a) evaporating and concentrating the waste liquid by applying heat in an evaporating vessel;

(b) condensing the vapor generated in said evaporating and concentrating step in a cooling vessel, wherein a pressure reducing device is provided for reducing the entire pressure in both said evaporating vessel and said cooling vessel, said vessels being in communication, and wherein a heat pump device is provided in which heat transfer media is hermetically sealed, and circulated through a compressor, heating means, said pressure reducing device and cooling means;

(c) separating the condensed liquid; and (d) processing the separated liquid by an activated sludge process, using microbes for treatment and disposal of raw sewage as initial sludge.

8. A method of processing a waste liquid in photographic processing, comprising the steps of:

(a) evaporating and concentrating the waste liquid by applying heat in an evaporating vessel;

(b) condensing the vapor generated in said evaporating and concentrating step in a cooling vessel, wherein a pressure reducing device is provided for reducing the entire pressure in both said evaporating vessel and said cooling vessel, said vessels being in communication, and wherein a heat pump device is provided in which heat transfer media is hermetically sealed, and circulated through a compressor, heating means, said pressure reducing device and cooling means;

(c) separating the condensed liquid; and (d) draining the separated condensate into activated sludge processing facilities for raw sewage to be processed in common with the raw sewage, wherein the separated condensate is processed by an activated sludge process, using microbes for treatment and disposal of raw sewage as initial sludge.

9. An automatic processing apparatus for processing photographic light-sensitive material, comprising:

(a) an automatic processor having (1) a processing tank containing a processing solution with which the photographic light-sensitive material is processed, and (2) means for replenishing a concentrated processing replenisher chemical solution to said processing tank, a deteriorated processing solution being restored by the concentrated processing replenisher chemical solution so that continuous photographic processing can be maintained;

(b) an evaporator/distillator processor by which waste liquid in photographic processing discharged from said automatic processor is evaporated and concentrated by heating, and vapor generated by the heating is condensed by cooling so that a condensate is produced;

(c) an electric dialysis device for separating the condensate into an electric dialysis concentrated liquid and a desalted liquid, wherein cation exchange membranes and anion exchange membranes are arranged alternately between a positive electrode and a negative electrode, and alternate concentrating chambers and desalting chambers are formed by both said ion exchange membranes and chamber frames; and (d) a desalted liquid storage tank for storing the desalted liquid, from which the desalted liquid is supplied to said processing tank, wherein the concentrated processing replenisher chemical solution is supplied in a quantity ranging from 1/30 to 1/50 of the amount of the desalted liquid to be supplied.

10. An automatic processing apparatus for processing photographic light-sensitive material, comprising:

(a) an automatic processor having (1) a processing tank containing a processing solution with which the photographic light-sensitive material is processed, and (2) means for replenishing a concentrated processing replenisher chemical solution to said processing tank, a deteriorated processing solution being restored by the concentrated processing replenisher chemical solution so that continuous photographic processing can be maintained;

(b) an evaporator/distillator processor by which waste liquid in photographic processing discharged from said automatic processor is evaporated and concentrated by heating, and vapor generated by the heating is condensed by cooling so that a condensate is produced;

(c) an electric dialysis device for separating the condensate into an electric dialysis concentrated liquid and a desalted liquid, wherein cation exchange membranes and anion exchange membranes are arranged alternately between a positive electrode and a negative electrode, and alternate concentrating chambers and desalting chambers are formed by both said ion exchange membranes and chamber frames; and (d) a desalted liquid storage tank for storing the desalted liquid, from which the desalted liquid is supplied to said processing tank, wherein said processing tank further comprises a solution level detection means, the desalted liquid being supplied based on a detection signal of said solution level detection means.

11. An automatic processing apparatus for processing photographic light-sensitive material, comprising:

(a) an automatic processor having (1) a processing tank containing a processing solution with which the photographic light-sensitive material is processed, and (2) means for replenishing a concentrated processing replenisher chemical solution to said processing tank, a deteriorated processing solution being restored by the concentrated processing replenisher chemical solution so that continuous photographic processing can be maintained;

(b) an evaporator/distillator processor by which waste liquid in photographic processing discharged from said automatic processor is evaporated and concentrated by heating, and vapor generated by the heating is condensed by cooling so that a condensate is produced, wherein waste liquids in photographic processing discharged from two or more automatic processors are subjected collectively to evaporator/distillator processing;

(c) an electric dialysis device for separating the condensate into an electric dialysis concentrated liquid and a desalted liquid, wherein cation exchange membranes and anion exchange membranes are arranged alternately between a positive electrode and a negative electrode, and alternate concentrating chambers and desalting chambers are formed by both said ion exchange membranes and chamber frames; and (d) a desalted liquid storage tank for storing the desalted liquid, from which the desalted liquid is supplied to said processing tank.

12. An automatic processing apparatus for processing photographic light-sensitive material, comprising:

(a) an automatic processor having (1) a processing tank containing a processing solution with which the photographic light-sensitive material is processed, and (2) means for replenishing a concentrated processing replenisher chemical solution to said processing tank, a deteriorated processing solution being restored by the concentrated processing replenisher chemical solution so that continuous photographic processing can be maintained;

(b) an evaporator/distillator processor by which waste liquid in photographic processing discharged from said automatic processor is evaporated and concentrated by heating, and vapor generated by the heating is condensed by cooling so that a condensate is produced;

(c) an electric dialysis device for separating the condensate into an electric dialysis concentrated liquid and a desalted liquid, wherein cation exchange membranes and anion exchange membranes are arranged alternately between a positive electrode and a negative electrode, and alternate concentrating chambers and desalting chambers are formed by both said ion exchange membranes and chamber frames; and (d) a desalted liquid storage tank for storing the desalted liquid, from which the desalted liquid is supplied to said processing tank, wherein waste liquids discharged from automatic processors for color negative films and those for color photographic papers are processed collectively, and desalted liquids produced are supplied to said automatic processors for color negative film and those for color photographic papers.

13. An automatic processing apparatus for processing photographic light-sensitive material, comprising:

(a) an automatic processor having (1) a plurality of processing tanks each containing a processing solution with which the photographic light-sensitive material is processed, and (2) means for replenishing a concentrated processing replenisher chemical solution to each of said plurality of processing tanks, a deteriorated processing solution being restored by the concentrated processing replenisher chemical solution so that continuous photographic processing can be maintained;

(b) an evaporator/distillator processor by which waste liquid in photographic processing discharged from said automatic processor is evaporated and concentrated by heating, and vapor generated by the heating is condensed by cooling so that a condensate is produced;

(c) an electric dialysis device for separating the condensate into an electric dialysis concentrated liquid and a desalted liquid, wherein cation exchange membranes and anion exchange membranes are arranged alternately between a positive electrode and a negative electrode, and alternate concentrating chambers and desalting chambers are formed by both said ion exchange membranes and chamber frames;

(d) a desalted liquid storage tank for storing the desalted liquid, from which the desalted liquid is supplied to said processing tank; and (e) means for setting an amount of each concentrated processing replenisher chemical solution so that supply of all concentrated processing replenisher chemical solution to said plurality of processing tanks may be completed substantially simultaneously.

14. An automatic processing apparatus for processing photographic light-sensitive material, comprising:

(a) an automatic processor having (1) a processing tank containing a processing solution with which the photographic light-sensitive material is processed, and (2) means for replenishing a concentrated processing replenisher chemical solution to said processing tank, a deteriorated processing solution being restored by the concentrated processing replenisher chemical solution so that continuous photographic processing can be maintained;

(b) an evaporator/distillator processor by which waste liquid in photographic processing discharged from said automatic processor is evaporated and concentrated by heating, and vapor generated by the heating is condensed by cooling so that a condensate is produced;

(c) an electric dialysis device for separating the condensate into an electric dialysis concentrated liquid and a desalted liquid, wherein cation exchange membranes and anion exchange membranes are arranged alternately between a positive electrode and a negative electrode, and alternate concentrating chambers and desalting chambers are formed by both said ion exchange membranes and chamber frames; and (d) a desalted liquid storage tank for storing the desalted liquid, from which the desalted liquid is supplied to said processing tank, wherein desalted liquids, which are to be supplied to steps of washing or waterless stabilizing that both follow a step of fixing that is among processing steps in said automatic processor, are supplied separately from replenishment for processing of light-sensitive materials when an amount of photographic light-sensitive materials to be processed in a predetermined period of time is small.

15. An automatic processing apparatus for processing photographic light-sensitive material, comprising:

(a) an automatic processor having (1) a processing tank containing a processing solution with which the photographic light-sensitive material is processed, and (2) means for replenishing a concentrated processing replenisher chemical solution to said processing tank, a deteriorated processing solution being restored by the concentrated processing replenisher chemical solution so that continuous photographic processing can be maintained;

(b) an evaporator/distillator processor by which waste liquid in photographic processing discharged from said automatic processor is evaporated and concentrated by heating, and vapor generated by the heating is condensed by cooling so that a condensate is produced;

(c) an electric dialysis device for separating the condensate into an electric dialysis concentrated liquid and a desalted liquid, wherein cation exchange membranes and anion exchange membranes are arranged alternately between a positive electrode and a negative electrode, and alternate concentrating chambers and desalting chambers are formed by both said ion exchange membranes and chamber frames; and (d) a desalted liquid storage tank for storing the desalted liquid, from which the desalted liquid is supplied to said processing tank, said desalted liquid storage tank comprising a sterilizing means.

16. An automatic processing apparatus for processing photographic light-sensitive material, comprising:

(a) an automatic processor having (1) a processing tank containing a processing solution with which the photographic light-sensitive material is processed, and (2) means for replenishing a concentrated processing replenisher chemical solution to said processing tank, a deteriorated processing solution being restored by the concentrated processing replenisher chemical solution so that continuous photographic processing can be maintained;

(b) an evaporator/distillator processor by which waste liquid in photographic processing discharged from said automatic processor is evaporated and concentrated by heating, and vapor generated by the heating is condensed by cooling so that a condensate is produced;

(c) an electric dialysis device for separating the condensate into an electric dialysis concentrated liquid and a desalted liquid, wherein cation exchange membranes and anion exchange membranes are arranged alternately between a positive electrode and a negative electrode, and alternate concentrating chambers and desalting chambers are formed by both said ion exchange membranes and chamber frames;

(d) a desalted liquid storage tank for storing the desalted liquid, from which the desalted liquid is supplied to said processing tank; and (e) a waste liquid storage tank for storing waste liquid in photographic processing discharged from said processing tank, wherein the waste liquid is supplied to an evaporator/distillator processor from said waste liquid storage tank.

17. An automatic processing apparatus for processing photographic light-sensitive material, comprising:

(a) an automatic processor having (1) a processing tank containing a processing solution with which the photographic light-sensitive material is processed, and (2) means for replenishing a concentrated processing replenisher chemical solution to said processing tank, a deteriorated processing solution being restored by the concentrated processing replenisher chemical solution so that continuous photographic processing can be maintained;

(b) an evaporator/distillator processor by which waste liquid in photographic processing discharged from said automatic processor is evaporated and concentrated by heating, and vapor generated by the heating is condensed by cooling so that a condensate is produced;

(c) an electric dialysis device for separating the condensate into an electric dialysis concentrated liquid and a desalted liquid, wherein cation exchange membranes and anion exchange membranes are arranged alternately between a positive electrode and a negative electrode, and alternate concentrating chambers and desalting chambers are formed by both said ion exchange membranes and chamber frames;

(d) a desalted liquid storage tank for storing the desalted liquid, from which the desalted liquid is supplied to said processing tank; and (e) a replenisher tank for storing the concentrated processing replenisher chemical solution, wherein said replenisher tank is capable of being set on a receiving portion of said processing tank, and said replenisher tank and said receiving portion of said processing tank are the same in at least one of color and shape.

* * * * *

UNITED STATES PATENT AND TRADEMARK OFFICE

CERTIFICATE OF CORRECTION

PATENT NO. : 5,353,085

DATED : October 04, 1994

INVENTOR(S) : Masayuki KUREMATSU et al

It is certified that error appears in the above-indentified patent and that said Letters Patent is hereby corrected as shown below:

Claim 10, Column 30, Lines 29-34 indent lines two spaces instead of one, so that "(2)" starting line 29 aligns with "(1)" starting line 26.

Signed and Sealed this

Sixteenth Day of May, 1995

*Attest:*

Bruce Lehman

BRUCE LEHMAN

*Attesting Officer*

*Commissioner of Patents and Trademarks*